US011572641B2

(12) United States Patent
Yenici et al.

(10) Patent No.: US 11,572,641 B2
(45) Date of Patent: Feb. 7, 2023

(54) WOVEN FABRIC AND METHOD OF PRODUCTION THEREOF

(71) Applicant: CALIK DENIM TEKSTIL SAN. VE TIC. A.S., Istanbul (TR)

(72) Inventors: Hamit Yenici, Istanbul (TR); Ahmet Serhat Karaduman, Malatya (TR); Hulusi Bulus, Bostanbasi-Yesilyurt (TR); Kemal Kaya, Bostanbasi-Yesilyurt/Malatya (TR); Münevver Ertek Avci, Yesilyurt/Malatya (TR)

(73) Assignee: CALIK DENIM TEKSTIL SAN. VE TIC. A.S., Istanbul (TR)

( * ) Notice: Subject to any disclaimer, the term of this patent is extended or adjusted under 35 U.S.C. 154(b) by 135 days.

(21) Appl. No.: 16/093,043

(22) PCT Filed: Apr. 10, 2017

(86) PCT No.: PCT/EP2017/058574
§ 371 (c)(1),
(2) Date: Oct. 11, 2018

(87) PCT Pub. No.: WO2017/178438
PCT Pub. Date: Oct. 19, 2017

(65) Prior Publication Data

US 2019/0119835 A1 Apr. 25, 2019

(30) Foreign Application Priority Data

Apr. 11, 2016 (EP) ..... 16164695

(51) Int. Cl.
*D03D 13/00* (2006.01)
*D03D 15/567* (2021.01)

(52) U.S. Cl.
CPC ..... *D03D 13/004* (2013.01); *D03D 15/567* (2021.01); *D10B 2403/0114* (2013.01)

(58) Field of Classification Search
None
See application file for complete search history.

(56) References Cited

U.S. PATENT DOCUMENTS 2,254,339 A * 9/1941 Wylde ..... D03D 15/56 139/421
4,714,096 A * 12/1987 Guay ..... A44B 18/0034 139/391

(Continued)

FOREIGN PATENT DOCUMENTS

| | | | |
|---|---|---|---|
| DE | 29606123 | U1 | 6/1996 |
| EP | 2539493 | B1 | 5/2015 |
| JP | 2005187962 | A | 7/2005 |

OTHER PUBLICATIONS

Cay et al., Effects of Warp-Weft Density Variation, Fibres and Textiles, Jan./Mar. 2007, vol. 15, No. 1, pp. 91-94 (Year: 2007).*

(Continued)

*Primary Examiner* — Shawn Mckinnon
(74) *Attorney, Agent, or Firm* — Banner & Witcoff Ltd.

(57) ABSTRACT

Woven fabric, particularly a warp faced fabric, such as a denim fabric, comprising a front and a back, a plurality of picks extending in weft direction and a plurality of warp yarns extending in warp direction and bypassing picks at their front side to define over portions and bypassing picks at their back side to define under portions, wherein said plurality of warp yarns comprise frontside warp yarns and backside warp yarns, and the under portions of the backside warp yarns bypass more picks than the under portions of the frontside warp yarns.

20 Claims, 15 Drawing Sheets

(56) References Cited

U.S. PATENT DOCUMENTS

| | | | | |
|---|---|---|---|---|
| 2004/0035489 | A1 | 2/2004 | Thiriot | |
| 2009/0191777 | A1* | 7/2009 | Liao | D03D 15/08 442/184 |
| 2013/0217288 | A1* | 8/2013 | Martin | D03D 15/08 442/203 |
| 2016/0083877 | A1* | 3/2016 | Kalfa Kilickan | D06M 15/21 442/184 |

OTHER PUBLICATIONS

Brittanica (https://www.britannica.com/topic/denim) , page visited on Apr. 23, 2022. (Year: 2022).*

International Search Report and Written Opinion in International application No. PCT/EP2017/058574, dated Jul. 7, 2017.

International Preliminary Report on Patentability dated Oct. 16, 2018, and Written Opinion of the International Searching Authority—International application No. PCT/EP2017/058574.

Wikipedia: "Double cloth," <https://en.wikipedia.org/wiki/Double_cloth>, accessed Feb. 14, 2021, last edited on Dec. 5, 2020.

European Intention to Grant dated Feb. 2, 2021, Application No. 17 716 246.8.

* cited by examiner

T
H
41
43
53
6*
62
1
63
4
5
6
3
5*
51
V
C
A
B
2
6'''
4*

PATERN 8

WOVEN FABRIC AND METHOD OF PRODUCTION THEREOF

CROSS REFERENCE TO RELATED APPLICATIONS

This application is a National Stage of International Application No. PCT/EP2017/058574, filed Apr. 10, 2017, which claims priority to and the benefit of European (EP) Patent Application No. 16 164 695.5, filed Apr. 11, 2016, each of which is incorporated herein by reference in its entirety.

BACKGROUND

The disclosure relates to a woven fabric, preferably a warp-faced fabric, such as a denim fabric, which feels like a knitted fabric. The disclosure also relates to a method of production of such a knitted-like woven fabric.

Woven fabrics and knitted fabrics generally have very different properties. Woven fabrics such as denim, gabardine, poplin or linen are more stable than knitted fabrics but also more rigid so that they do not drape well. Denim is a very popular indigo dyed woven fabric due to the fact that the indigo dye is most concentrated at the surface of the yarns whereas the yarns' cores remain undyed which allows for very characteristic coloring options. Different finishing techniques can be applied to denim to enhance to the coloring properties. For example, denim can be hand scraped, sandblasted, stone washed, or treated in other ways that allow varying amounts of the undyed cores of the indigo yarns to become visible. Although denim is very popular and, it has, due to its woven nature, rarely been used for articles of clothing that are expected to drape well over the wearer's body, particularly tops, such as shirts, blouses and sweat-shirts.

For articles of clothing which are expected to drape well, knitted fabrics are used most often, because knitted fabrics are generally more flexible and able to stretch in every direction so that they drape well over the wearer's body. It is however very expensive to create knitted fabrics of indigo color. Unlike the ring-colored yarns used for weaving denim, the yarns used to create a knitted fabric must first be bound on a bobbin for dying, so that a time consuming and thus expensive additional manufacturing step is necessary. Furthermore, when manufacturing a knitted fabric, both sides thereof will be dyed, including the fabric's back side which is in contact with the wearer's skin and may thus leave stains.

In order to create a fabric that can be manufactured easily by weaving but which feels like a knitted fabric, EP 2 539 493 B1 suggests to weave warp yarns with two different types of weft yarns, namely elastomeric and hard weft yarns. The under portions of the elastomeric yarns are arranged to pass under for example two warp yarns, whereas the under portion of the hard weft yarns are much larger and pass under for instance eleven warp yarns, so that relatively large weft loops are formed on the back side of the fabric. The connecting over portions of elastomeric and hard weft yarns both pass over only one warp yarn and are arranged so that the hard weft yarn is always adjacent an elastomeric weft yarn passing over the same warp yarn. In the fabric according to EP 2 539 493 B1, the loop portions which are formed by the hard weft yarn enable the fabric to feel like a knitted fabric to the wearer, but require a relatively high weft density between typically 30 and 90 wefts per cm. This typically very high weft density requires a lot of weft insertions and thus renders the manufacturing process relatively expensive. The woven fabric according to EP 2 539 493 B1 also looks similar to a knitted fabric, because the over portions on the frontside of the fabric create not only one diagonal pattern, which is typical for denim, but also a second diagonal pattern created by the over portions of the hard weft yarn, which is offset with respect to the first diagonal pattern. However, it is desired to have a woven fabric that offers the performance advantages of a knitted fabric while still having the look of typical denim.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
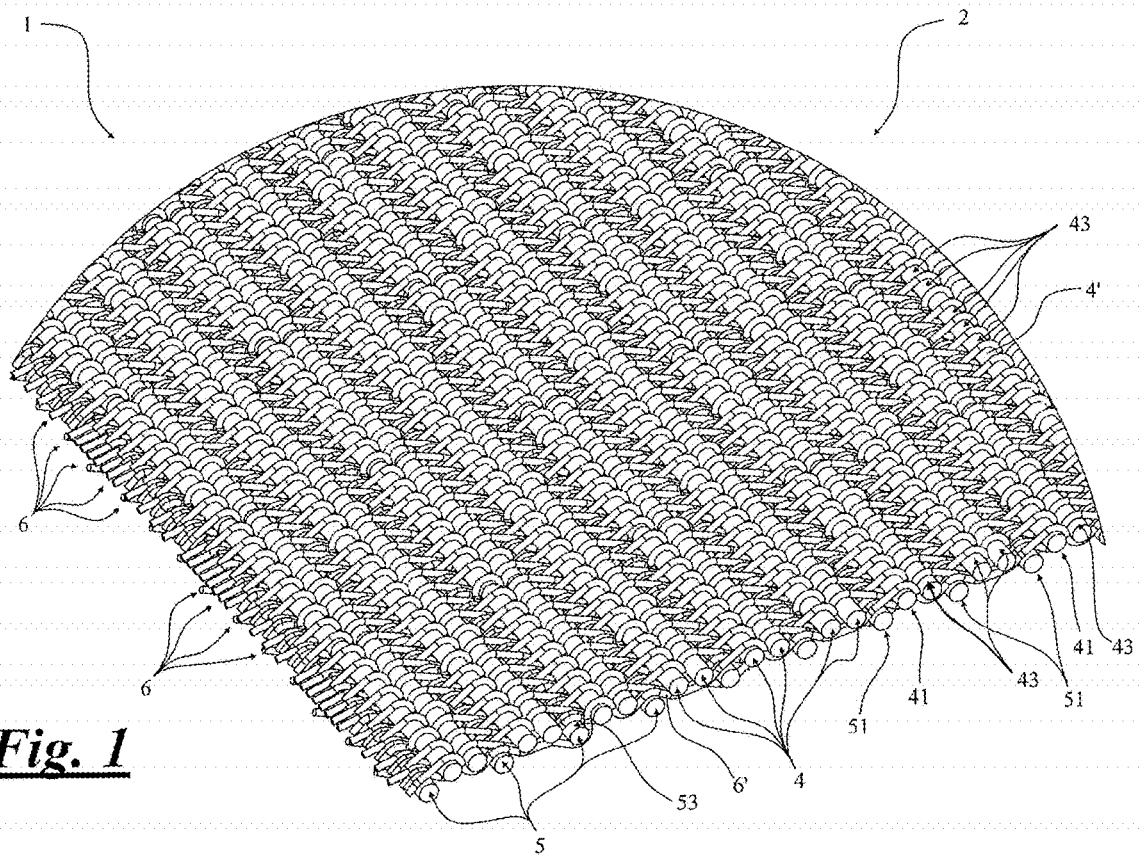
FIG. 1 shows a perspective view onto the front of the woven fabric according to an exemplary embodiment of the present disclosure.
Figure 2:
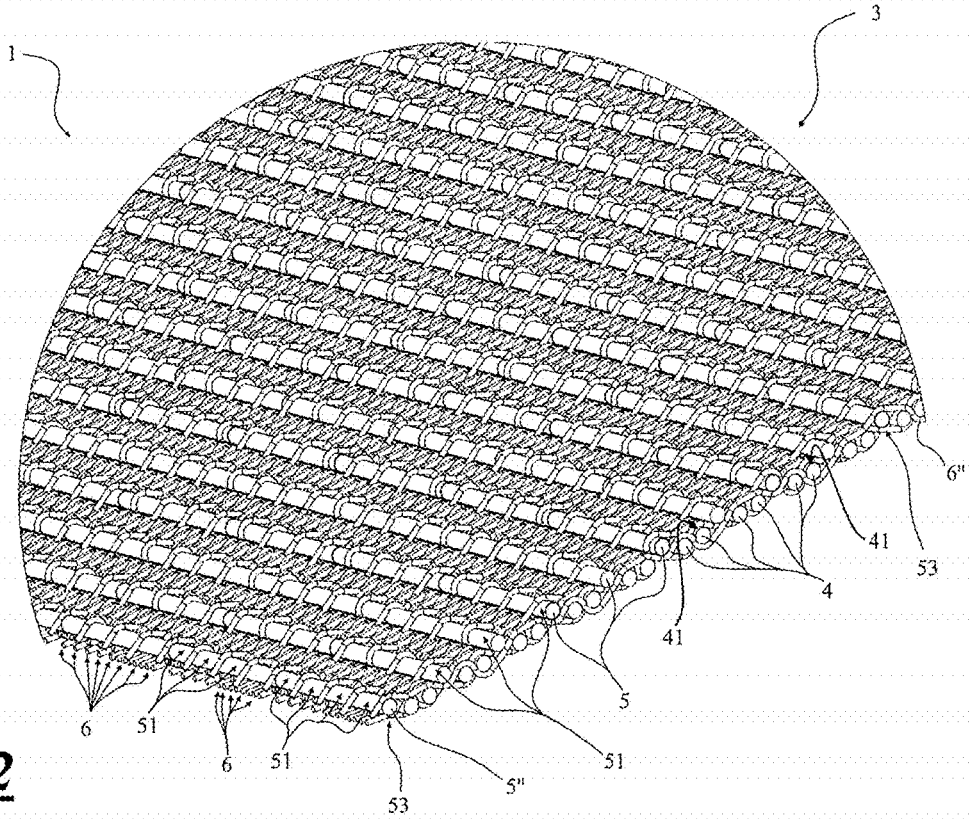
FIG. 2 shows a perspective view onto the back of the woven fabric of FIG. 1.
Figures 2A, 2B, 3:
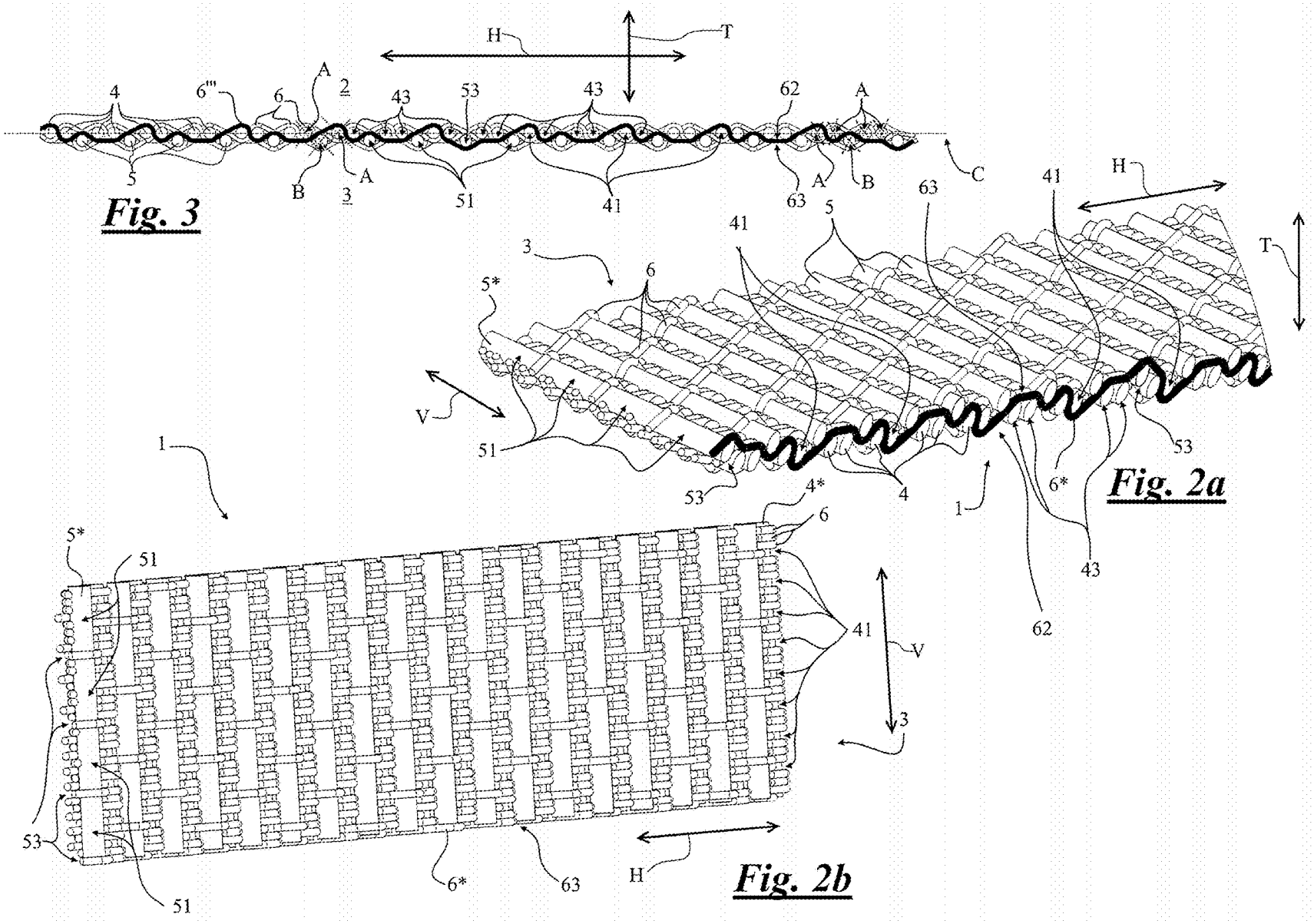
Figure 4A:
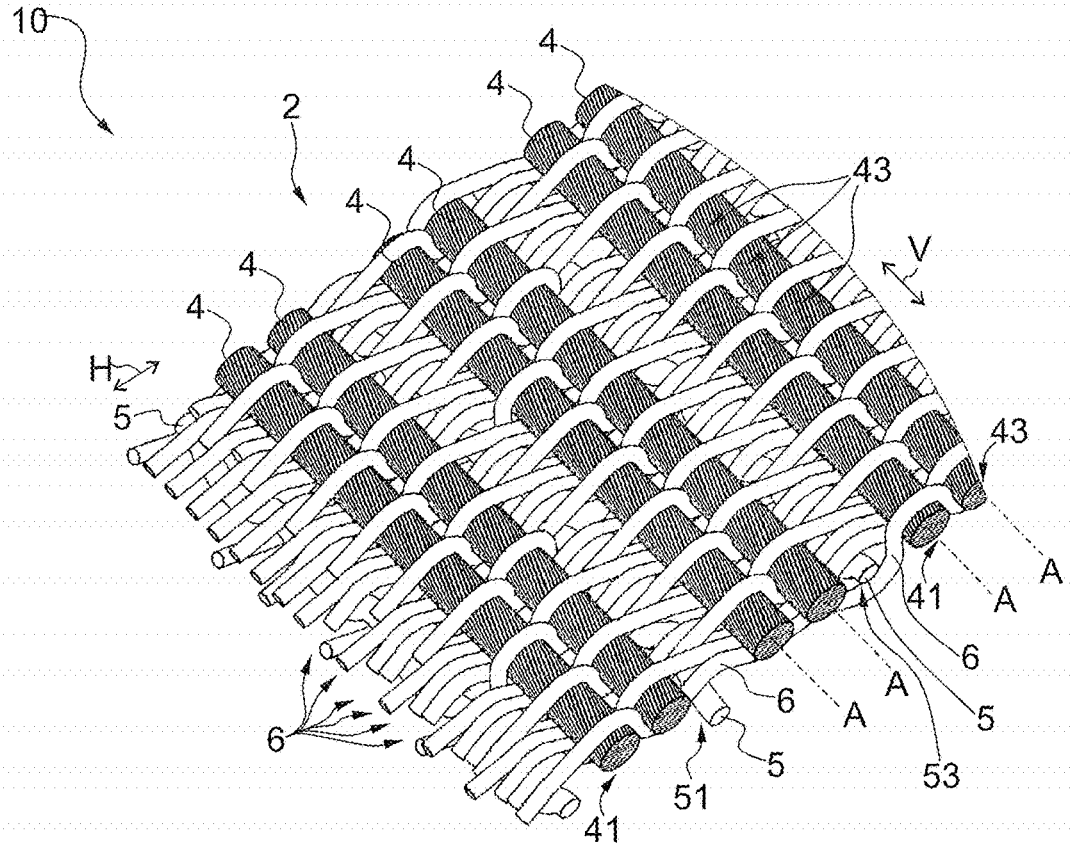
Figure 4B:
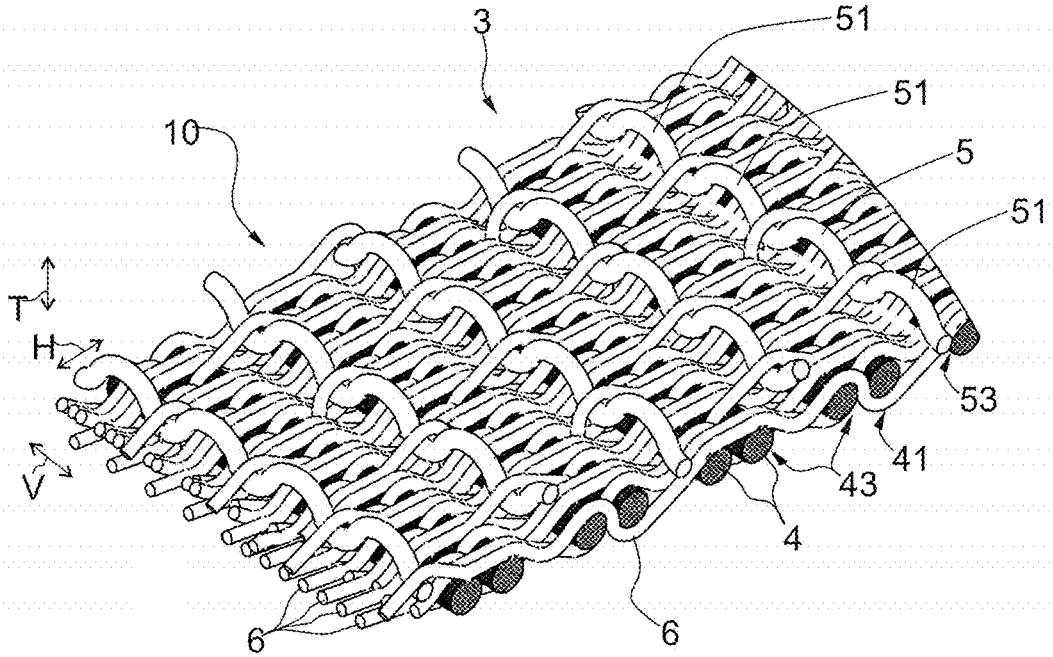

FIG. 2*a* shows a different perspective view onto the back of the woven fabric of FIG. 1;

FIG. 2*b* shows another view onto the back of the woven fabric according to FIG. 2;

FIG. 3 shows a cross sectional view in warp direction of the woven fabric according to FIG. 1;

FIG. 4*a* shows a perspective view onto the front of an exemplary embodiment of a woven fabric according to the disclosure after shrinking FIG. 4*b* shows a perspective view onto the back of the woven fabric according to FIG. 4*a;*

Figure 5A:
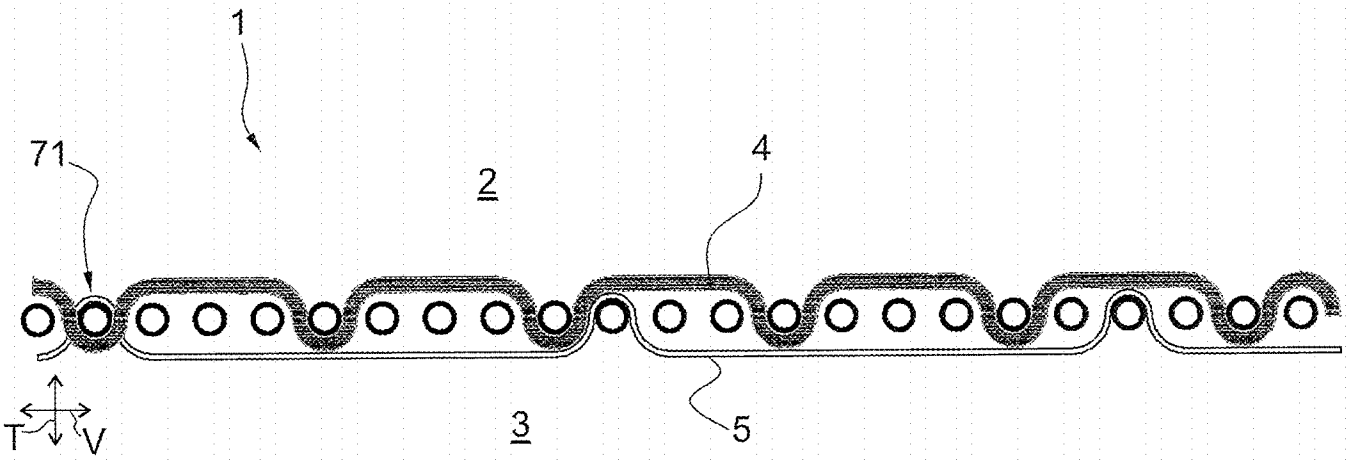
Figure 5B:
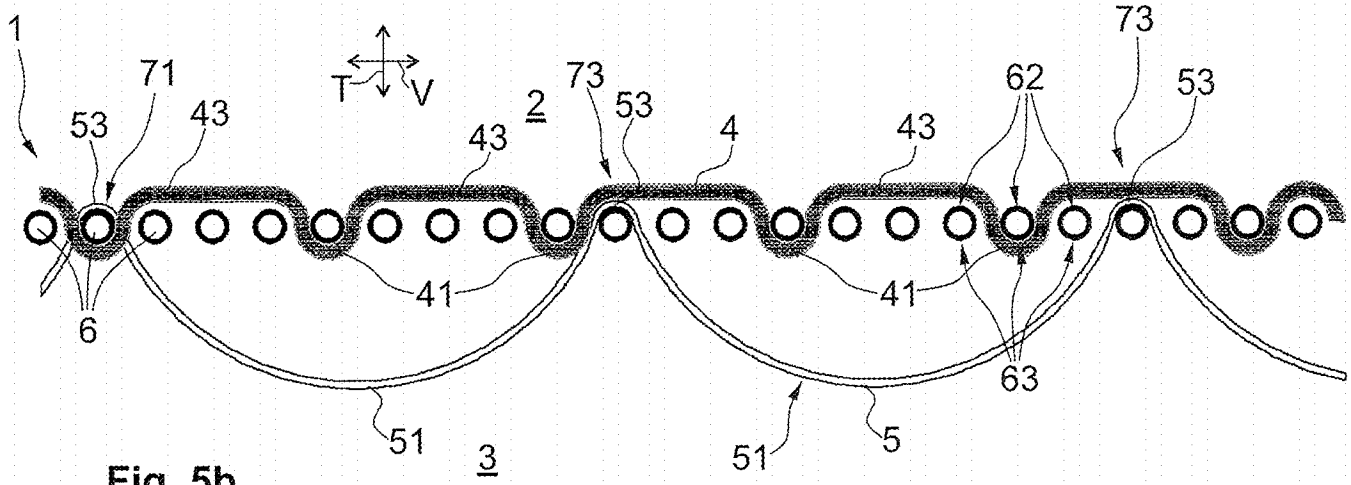
Figure 6A:
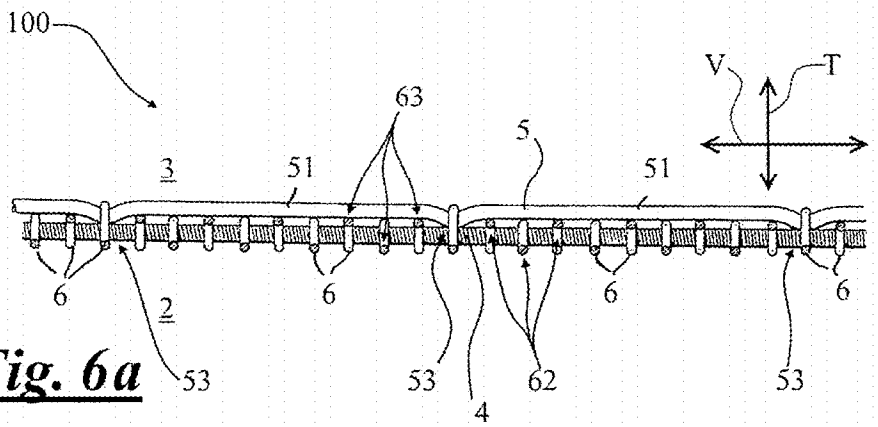
Figure 6B:
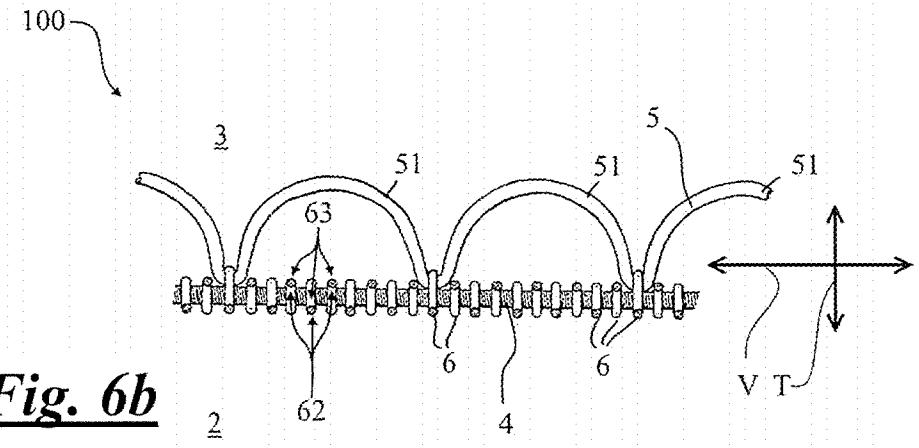
Figure 7:
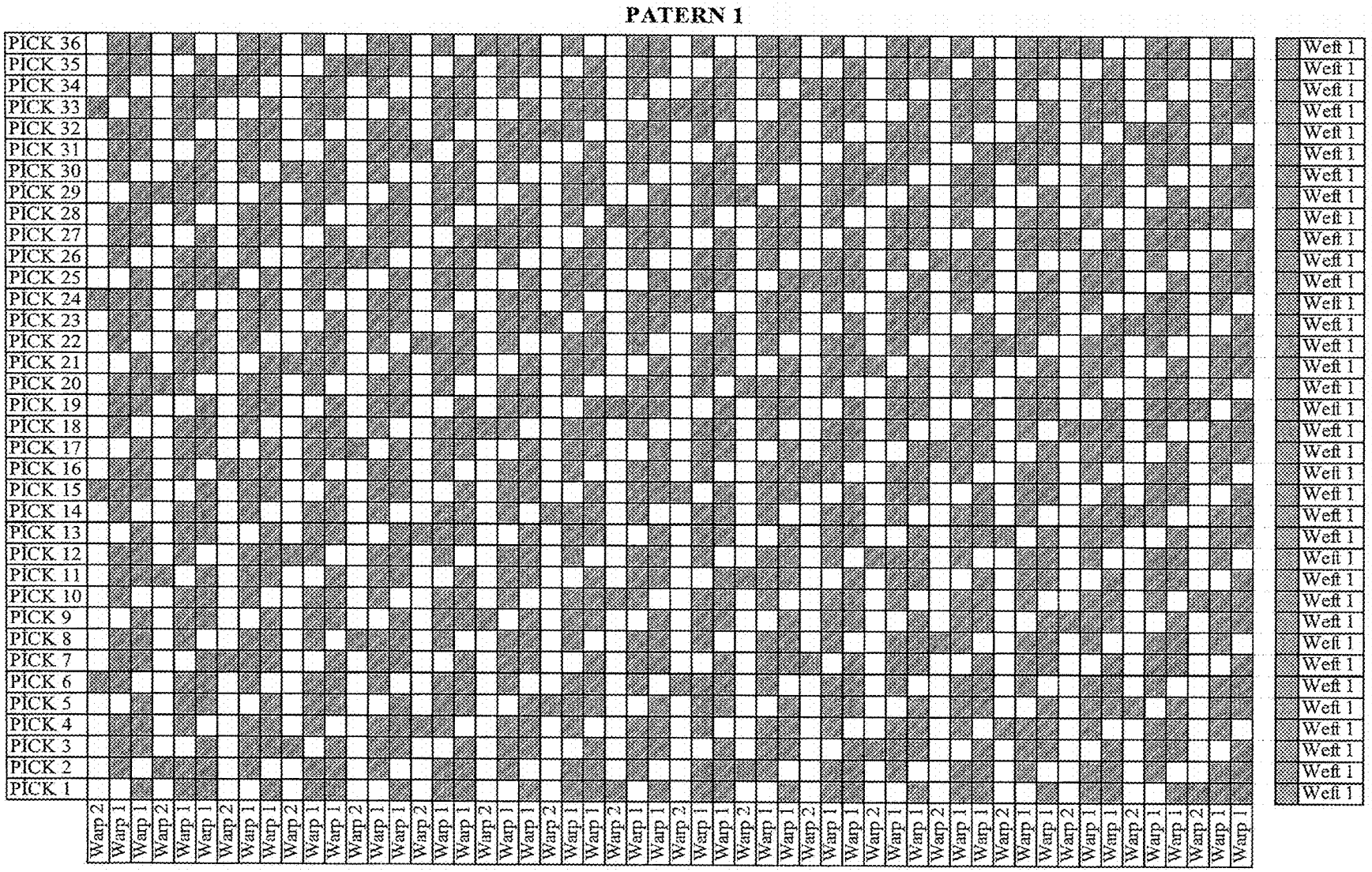

FIG. 5*a* shows a schematic sectional view of a woven fabric according to FIG. 1 in weft direction;

FIG. 5*b* shows a cross sectional view in weft direction of the woven fabric shown in FIG. 6*a* after shrinking;

FIG. 6*a* shows a schematic sectional view of a woven fabric according to an exemplary embodiment of the disclosure in weft direction; and FIG. 6*b* shows a cross sectional view in weft direction of the woven fabric shown in FIG. 6*a* after shrinking;

FIG. 7 shows a weave pattern of the warp faced woven fabric according to FIG. 1

Figure 8:
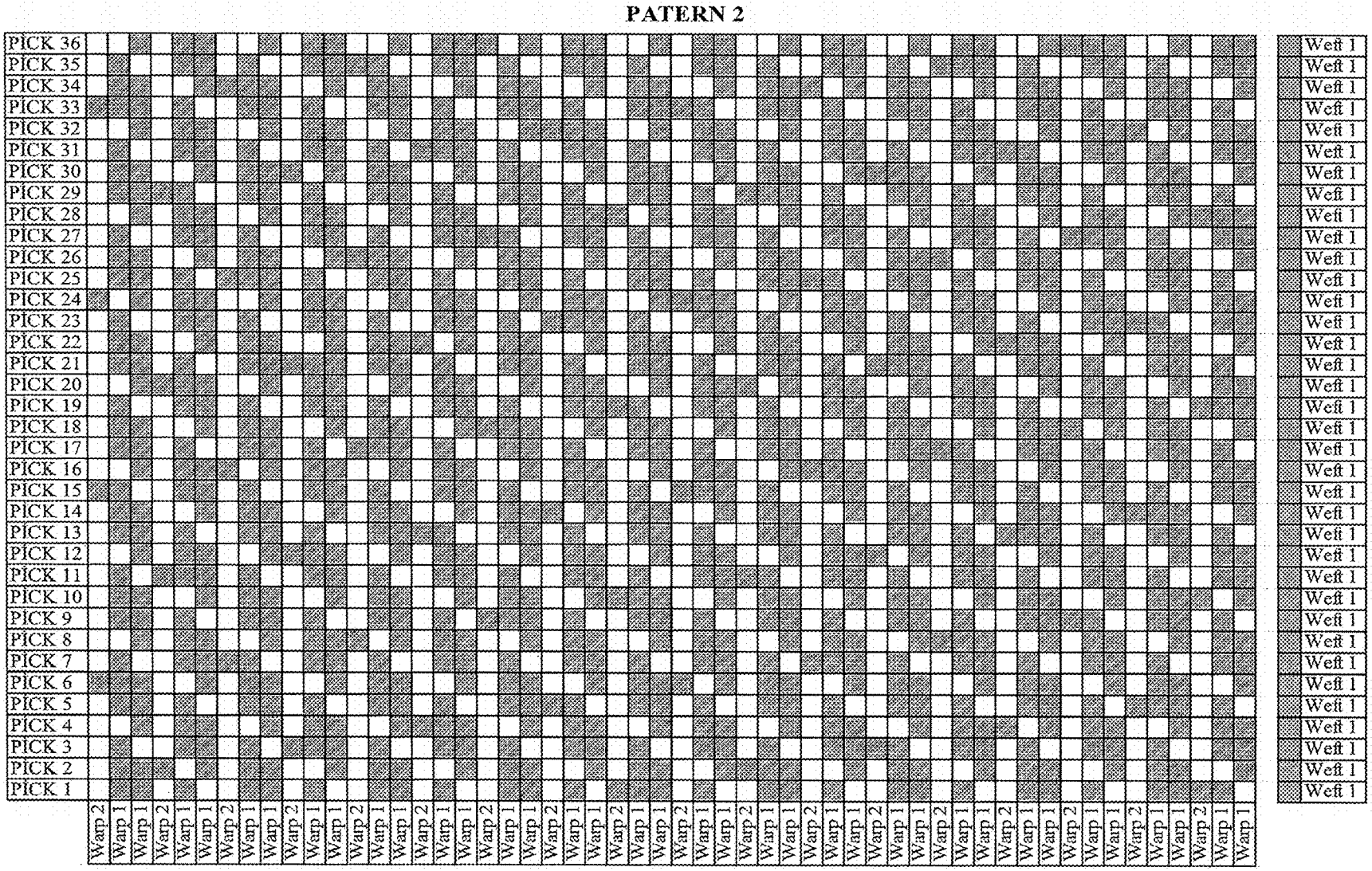
Figure 9:
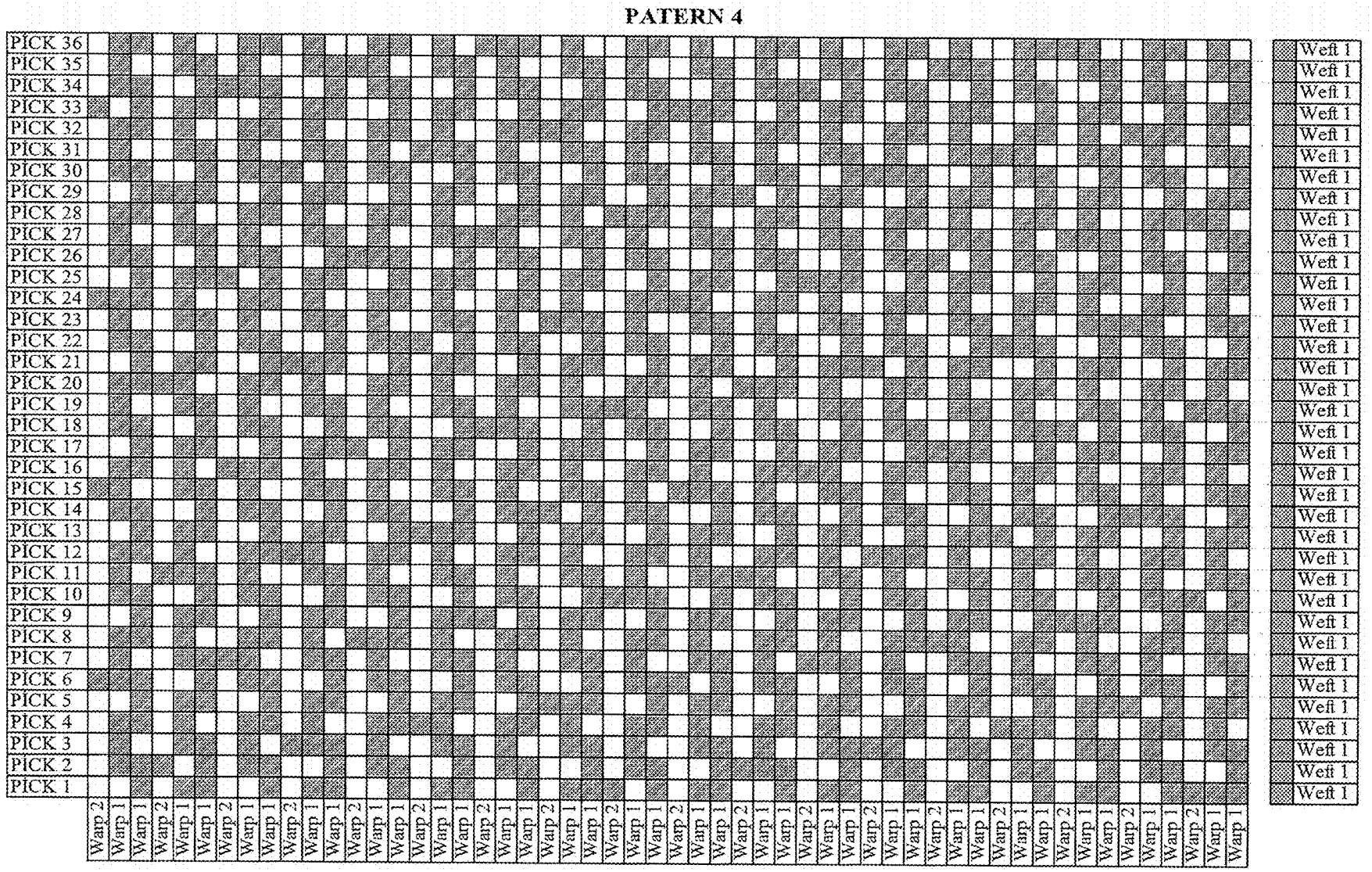
Figure 10:
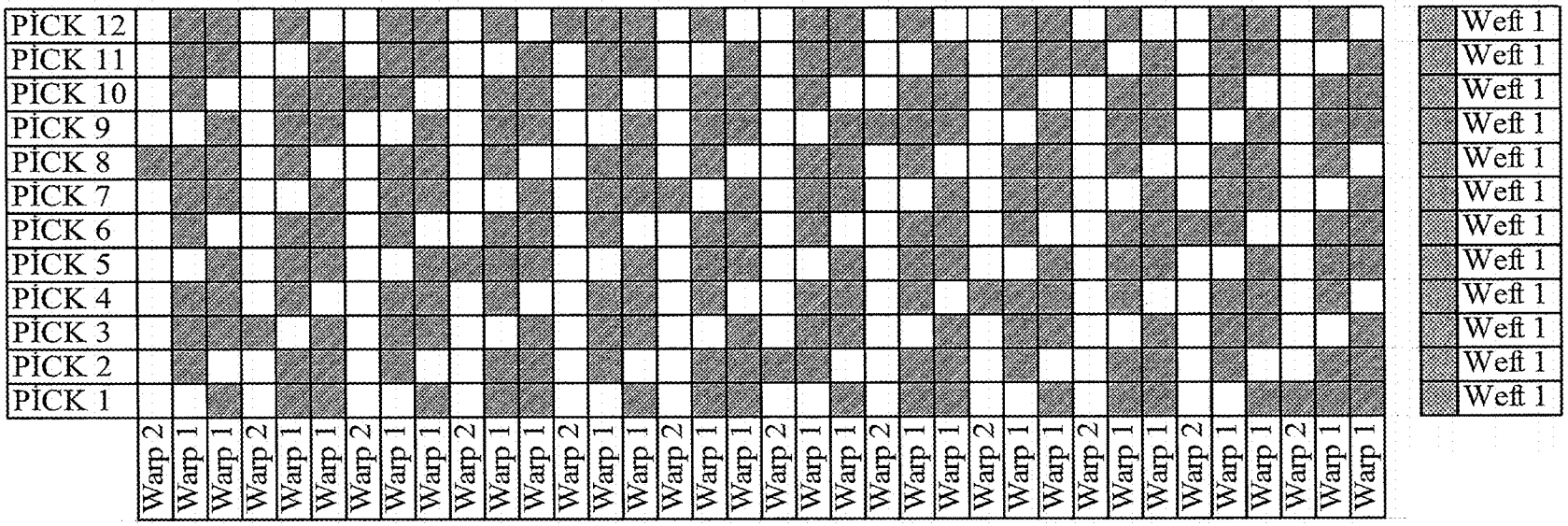
Figure 11:
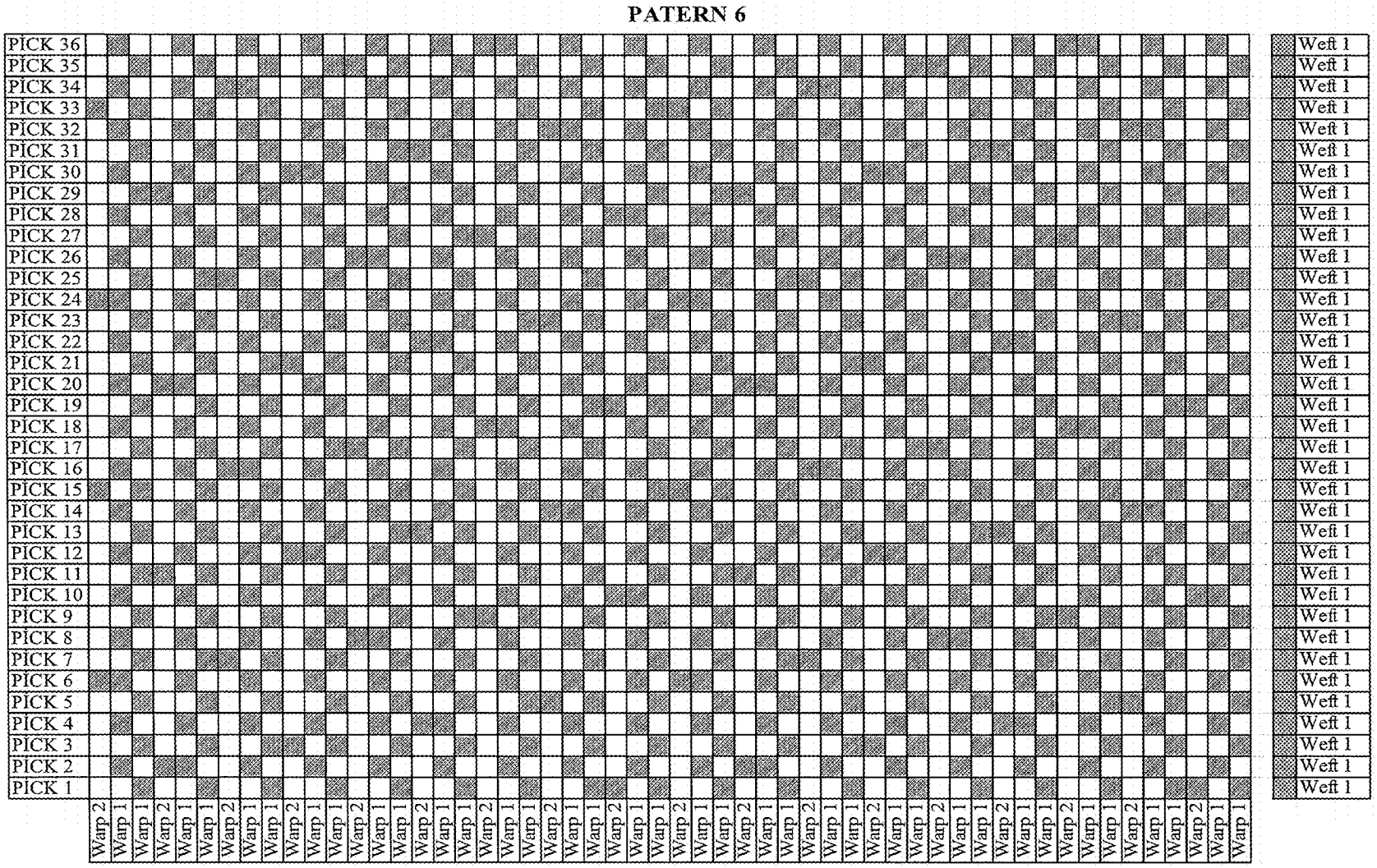
Figure 12:
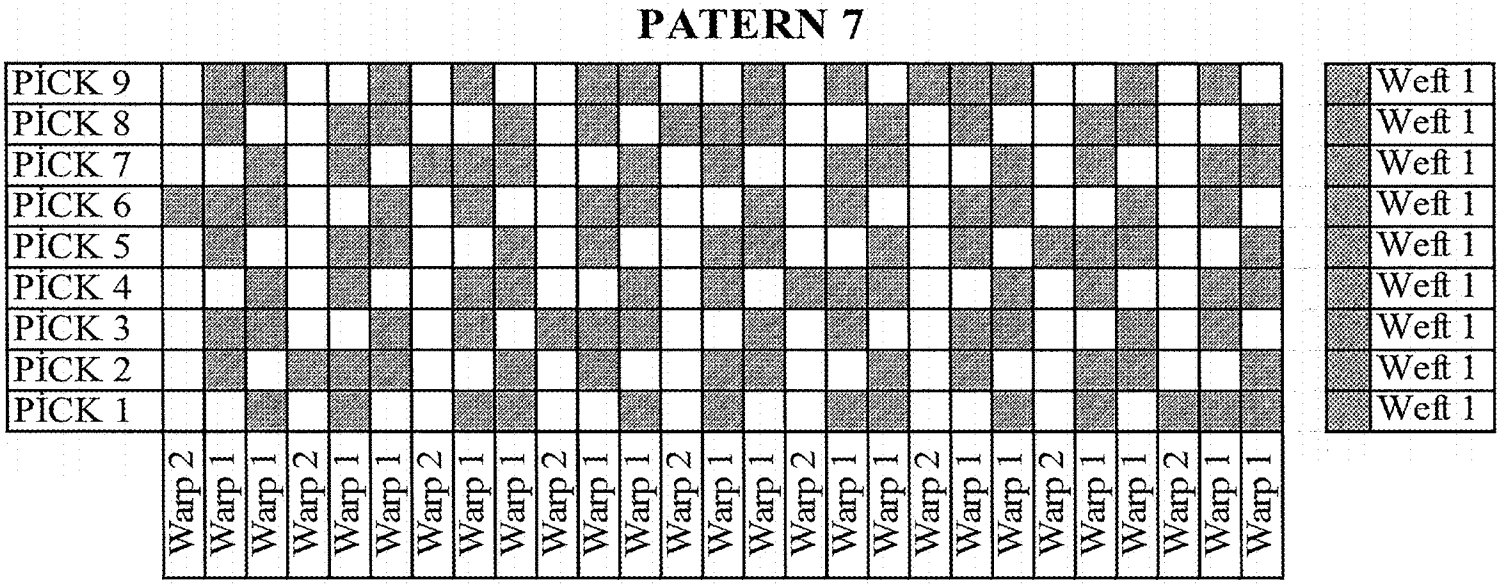
Figure 13:
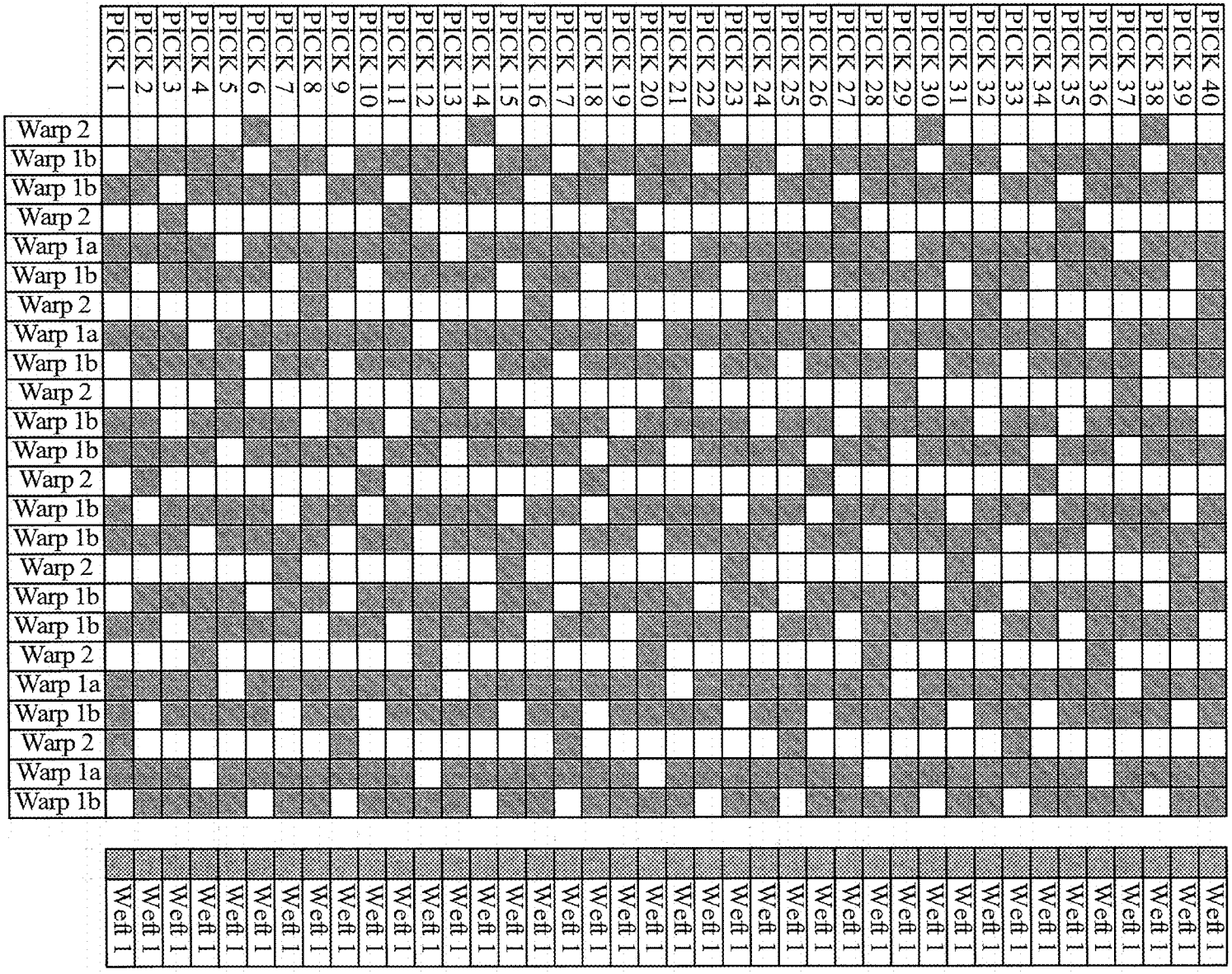
Figure 14:
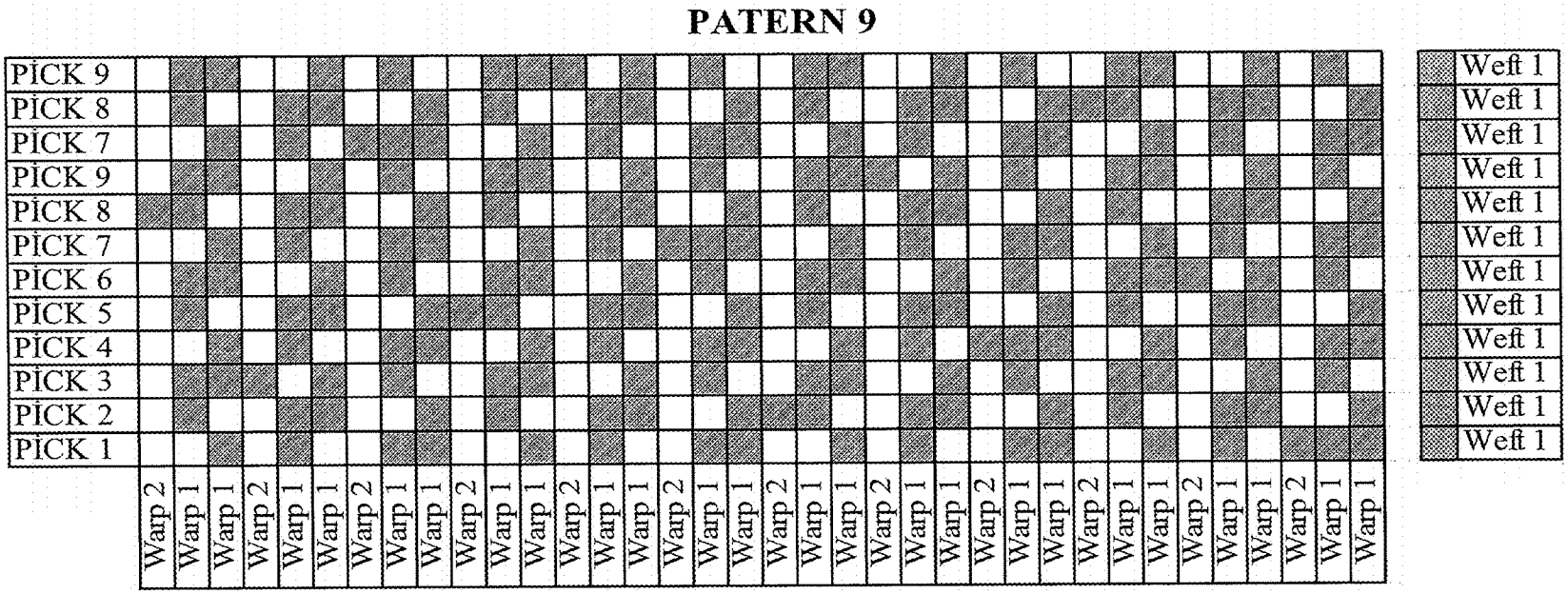
Figure 15:
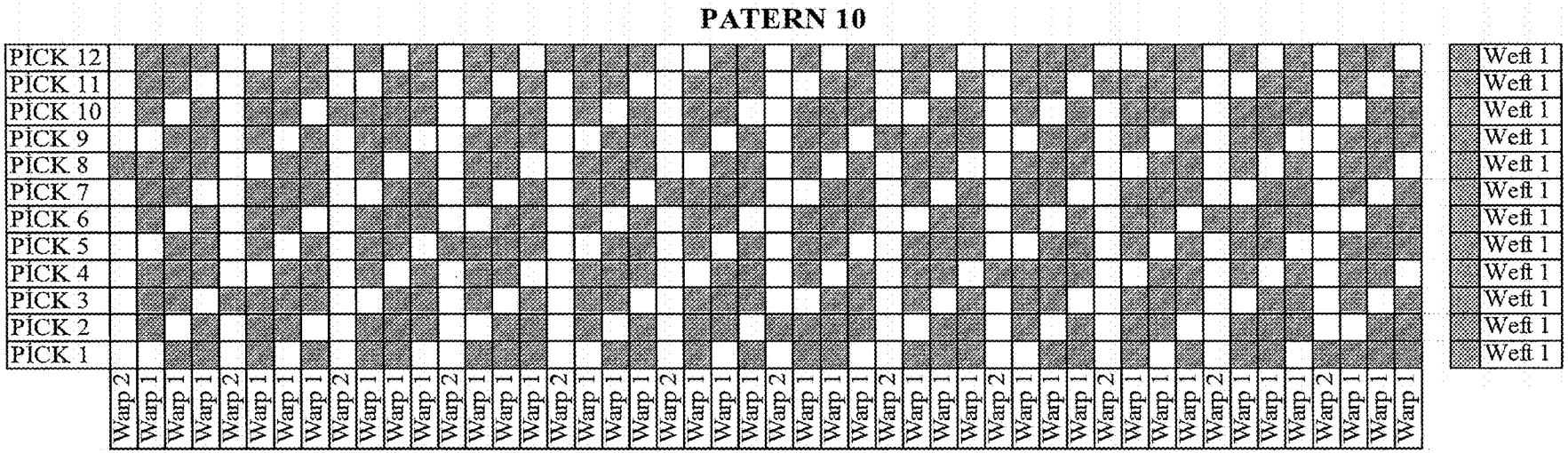
Figure 16:
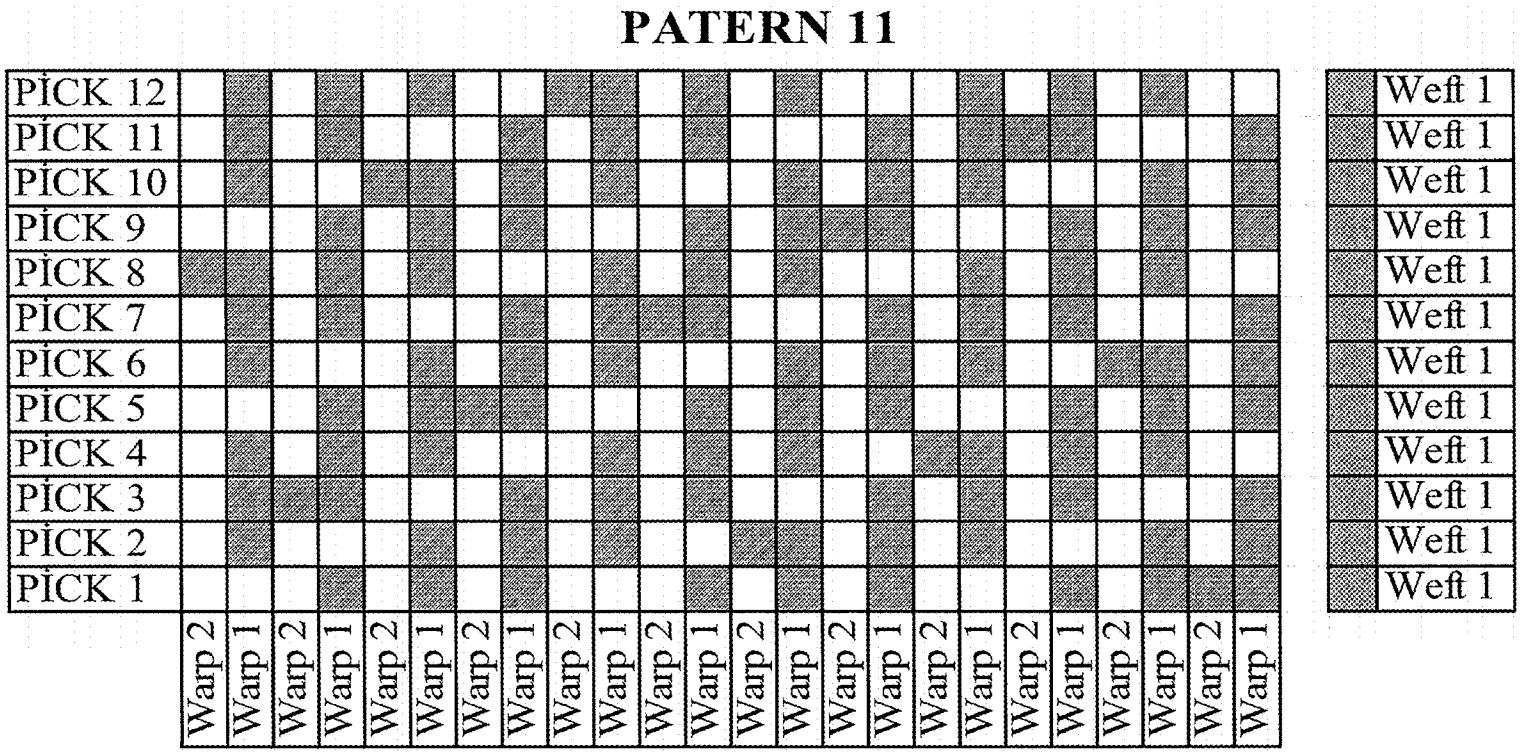

FIG. 8 shows an exemplary embodiment of a weave pattern of a warp faced woven fabric according to the disclosure;

FIG. 9 shows an exemplary embodiment of a weave pattern of a warp faced woven fabric according to the disclosure;

FIG. 10 shows an exemplary embodiment of a weave pattern of a woven fabric according to the disclosure;

FIG. 11 shows an exemplary embodiment of a weave pattern of a woven fabric according to the disclosure in which the frontside warp yarns provide the appearance of a plain weave;

FIG. 12 shows an exemplary embodiment of a weave pattern of a woven fabric according to the disclosure;

FIG. 13 shows an exemplary embodiment of a weave pattern of a woven fabric according to the disclosure FIG. 14 shows an exemplary embodiment of a weave pattern of a woven fabric according to the disclosure FIG. 15 shows an exemplary embodiment of a weave pattern of a woven fabric according to the disclosure; and FIG. 16 shows an exemplary embodiment of a weave pattern of a woven fabric according to the disclosure.

The exemplary embodiments of the present disclosure will be described with reference to the accompanying drawings. In the drawings, the same or similar reference signs are used for identical or similar components.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

It is an objective of the disclosure to overcome the drawbacks of the prior art, particularly to provide a knitted-like woven fabric which incarnates the visible properties of a denim fabric with the flexibility and drapeability of a knitted fabric and which preferably is also cheap to manufacture. This objective is solved by the subject matter of the independent claims.

In a first aspect, the disclosure relates to a woven fabric, preferably a warp faced fabric, such as a denim fabric, comprising a front and a back. The front of the fabric can be referred to as the technical face side which, for a typical warp faced fabric, such as a twill fabric, has the most pronounced wale. The front is the side which will be visibly presented on the front of the products made from the woven fabric according to the disclosure. The selvedge always runs in the warp (lengthwise) direction of a woven fabric. It is possible to identify the warp yarns in a woven fabric with the aid of so called reed lines. By slightly stretching the fabric, in particular in the weft direction, light can pass through the fabric from the back to the front through the reed line, which extends in warp direction. The reed lines are invariably created during the weaving process, although they may sometimes be difficult to see for an inexperienced observer. Although all the warp yarns come relatively closely together after weaving, there will always remain a small space between immediately neighboring warp yarns due to the thickness of a steel reed dents, which dents are formed during weaving as the reed of the loom pushes the latest pick of weft yarn towards the produced fabric, which can be called beating. The front side warp yarns are usually the warp yarns which are indigo dyed and may be the only indigo dyed yarns of the fabric. Usually, the front is also the side which is visible during weaving. The back of the fabric can also be called the technical back. The back of the fabric is the side intended to be in contact with the wearer's body. Denim fabric is a typical warp-faced fabric in which the front of the fabric is visibly dominated by indigo-dyed warp yarns, whereas the back of the fabric commonly shows mainly weft yarn(s). Other warp-faced fabrics include twill, cavalry twill, chino, covert, denim, drill, fancy twill, gabardine, and lining twill.

The woven fabric according to a first aspect of the disclosure includes, preferably consists of, picks and warp yarns. The warp yarns and the picks can be interlaced at right angles to each other, such that the warp yarns define a (vertical) warp direction and the picks define a (horizontal) weft direction preferably orthogonal to the warp direction. The picks extend in weft direction. The picks of the woven fabric can be formed by one or more weft yarns. A pick or weft pick can be described as a section of a weft yarn extending from one horizontal end of a fabric to the other horizontal end (perpendicular to the warp direction).

The warp yarns, preferably most of or all warp yarns, extend in warp direction and bypass picks at their frontside to define over portions and bypass picks at their back side to define under portions. The warp yarns could also be referred to as warp ends. At least before washing, the warp yarns may lie straighter and more parallel in the fabric because of loom tension. The frontside of a pick is the side of said pick facing towards the front of the fabric. It shall be clear that one or more warp yarns may be in front of a pick's frontside so that the frontside of the pick may not always be visible to a person looking at the front of the woven fabric. In the same manner, the back side of a pick is the side of the pick which faces towards the back of the fabric, wherein one or more warp yarns may be behind the back side of the pick. However, if a pick is visible on the frontside of the fabric, the portion visible will be part of a frontside of that pick. The visible portion of pick visible at the back side of a fabric is part of the pick's back side. The under portions and the over portions of each warp yarn form a generally sinusoidal pattern, when looking at a warp yarn from a side view (in weft direction). The warp yarns form alternately arranged under portions and over portions with respect to the picks. An over portion extends between two adjacent under portions of a warp yarn. Each under portion extends on the back side of the picks between two adjacent over portions. The over portions of the warp yarn are usually visible at the front of a fabric and therefore dominate the appearance of the fabric's front. The under portions of the warp yarns will be visible on the back of the fabric and come into contact with a wearer's skin.

According to the first aspect of the disclosure, the warp yarns comprise, preferably consist of, frontside warp yarns and backside warp yarns. According to the first aspect of the disclosure, in particular for at least 25%, at least 50%, at least 75%, at least 80%, at least 90% or all of the frontside and backside warp yarns, the under portions of the backside warp yarns, preferably all or most of the under portions of the backside warp yarns, bypass more picks than the under portions of the frontside warp yarns, preferably all or most of the under portions of the frontside warp yarns. Preferably, the frontside warp yarns are provided for visibly appearing on the face of a fabric or, in other words, for showing on the front of the fabric. The backside warp yarns are preferably provided for contacting skin of a wearer and/or covering the back of the fabric. By selecting the number of picks which are bypassed by loop portions or under portions of backside warp yarns such that they are larger than the number of picks bypassed by the under portions of frontside warp yarns, a weave pattern is achieved in which most of the backside warp yarns are arranged towards the back of the fabric, wherein the frontside warp yarns are arranged towards the front of the fabric. The visible impression of the warp faced woven fabric according to the disclosure is thus dominated by the appearance of the frontside warp yarns which hide behind them the backside warp yarns.

It is a general concept of the disclosure to provide a, particularly warp faced, woven fabric that has two distinguishable sets of warp yarns. A first set of warp yarns, which are referred to as frontside warp yarns, are generally woven with the weft yarn(s) to create a woven fabric of a typical design, preferably having a denim-like look. The second set of warp yarns, which are herein referred to as backside warp yarns, can be imagined as being a interwoven with the woven fabric of the first set of warp yarns and the weft yarn(s) such that the second set of warp yarns is arranged mainly at the back of the fabric. This can be realized for instance by weaving the second set of warp yarns with relatively large under portions and possibly small over portions and/or by using a number of backside warp yarns which may be significantly smaller in relation to the number of the frontside warp yarns and/or by selecting thinner backside than frontside warp yarns and/or by selecting frontside warp yarns having a greater shrinkage ratio than the selected backside warp yarns and/or by selecting a weaving pattern that results in a larger crimping of the frontside warp yarns with respect to the backside warp yarns and/or by subjecting the frontside warp yarns to a larger tensile tension than the backside warp yarns during weaving to create a woven fabric having a draft ratio, preferably a draft ratio between 5% and 50%, more preferably between 10% and 25%. Alternatively or additionally, the frontside warp yarns and the backside warp yarns may differ in their behavior with respect to heat treatment, treatment by washing, treatment by solvents, or the like, in order to obtain a warp faced woven fabric as described above. In such a woven fabric, the backside warp yarns are the yarns which predominantly come into contact with the skin of person wearing clothing comprising woven fabric in accordance with the disclosure. Those backside warp yarns provide a very soft feeling, very similar to the feeling provided by a knitted fabric. At the same time, the front of the fabric visually appears almost identical to that of a typical woven fabric, because the front shows mostly frontside warp yarns and picks. A woven fabric in accordance with the disclosure can also be realized for a fabric having the outward appearance of a sateen weave or a plain weave. The visible weave pattern of the front can be very similar to different known patterns. It is preferred that the visible pattern shall appear as a common denim weave, such as a 3/1-weave. Other weaves are also possible. Common weaves are for example 2/1, 1/1, 4/1, 3/1 broken twill, 4/1 sateen or the like. The patterns that are visible on the front are essentially realized using only the frontside warp yarns and the picks. The additional backside warp yarns, which are arranged at the back of the fabric, realize a knitted-like behavior so that the back of the fabric looks like a knitted fabric and feels softer and more flexible than a typical woven fabric. Also, in comparison to typical denim fabrics which stretch only in weft direction, the fabric according to the disclosure may easily be produced as a so-called bi-stretch fabric due to the use of different frontside and backside warp yarns.

In a preferred embodiment of the disclosure, in particular for at least 25%, at least 50%, at least 75%, at least 80%, at least 90% or all of the backside warp yarns, said under portions of the plurality of loop warp yarns, in particular most or all of said under portions of the plurality of loop warp yarns, bypass more than two picks and/or less than 41 picks, preferably 4 to 24 picks, more preferably 9 to 6 picks, in particular exactly 8, 9, 10, 11, 12, 13, 14, 15 or 16 picks. Most or all of the under portions of a backside warp yarn can extend along or bypass the back side of at least 4, 5, 6, 7 or more picks. It has been shown that for a woven fabric that shall look very similar to a 3/1 body weave denim fabric, loop yarns having under portions extending over exactly 8 or 11 or 14 or 15 picks look almost indistinguishable from a normal denim fabric. If the number of picks bypassed by the under portions of a backside warp yarn is too large, the woven fabric may have unfavorably large loop portions that tear easily during production or when the fabric is worn.

In a preferred embodiment of the disclosure, in particular for at least 25%, at least 50%, at least 75%, at least 80%, at least 90% or all of the backside warp yarns, the under portions of the backside warp yarns, preferably most or all of the under portions of the backside warp yarn, bypass 1, 2, 3, 4, 5, 6, 7, 8, 9 or 10 more picks than the under portions of the frontside warp yarns, preferably than most or all of the under portions of the backside warp yarn. In a preferred embodiment of the disclosure, in particular each of, the under portions of the backside warp yarns bypass at most 40, 35, 30 or 25 more picks than, in particular each of, the under portions of the front side warp yarns. Preferably, in particular each of, the under portions of the backside warp yarns bypass 3 to 23, more preferably 8 to 15, picks more than, in particular each of, the under portions of the frontside warp yarns.

In a preferred embodiment of the disclosure, in particular for at least 25%, at least 50%, at least 75%, at least 80%, at least 90% or all of the backside warp yarns, the under portions of the backside warp yarns, preferably most or all of the under portions of the backside warp yarn, bypass more picks than the over portions of said backside warp yarns, preferably most or all of the over portions of said backside warp yarns. By selecting the number of picks which are bypassed, or in other words, the extension of the over portions of a backside warp yarn, to be smaller than the extension of said backside warp yarns' under portions, the visual occurrence of backside warp yarns at the front of the fabric can be minimized and the effect on the back side of the fabric to establish a knitted-like feeling can be maximized. Preferably, the extension or number of picks bypassed by an over portion of a warp yarn can be two or less, particularly exactly one. Preferably, each backside warp yarns' under portions may have two adjacent over portions of which at least one, preferably both, bypasses a smaller number of picks than the number of picks bypassed by the under portion. For example, in the preferred embodiment, a backside warp yarn could have over portions, all of which extend over only one or only two picks, and under portions, which may be called loop portions, all of which bypass two or more picks.

In a preferred embodiment of the disclosure, in particular for at least 25%, at least 50%, at least 75%, at least 80%, at least 90% or all of the backside warp yarns, a loop ratio of a number of picks bypassed by the, preferably by all, under portions of one, preferably each one, of the backside warp yarns to the number of picks bypassed by the, preferably all, over portions of said backside warp yarn is more than 2:1, 3:1, 4:1, 5:1 and less than 40:1, less than 30:1 or less than 24:1, preferably, the loop ratio is between 4:1 and 24:1 more preferably more preferred between 9:1 and 16:1. Preferably, the loop ratio is 8:1, 9:1, 10:1, 11:1, 12:1, 13:1 or 14:1, in particular for embodiments in which the frontside and backside warp yarns have different shrinkage ratios, as described below. Preferably, the loop ratio is 11:1 or higher, such as 14:1 or 15:1, in particular for embodiments in which the frontside and backside warp yarns have similar or identical shrinkage ratios.

In a preferred embodiment of the disclosure, in particular for at least 25%, at least 50%, at least 75%, at least 80%, at least 90% or all of the warp yarns, the frontside warp yarns and the backside warp yarns are selected, designed and/or woven such that said underportions, preferably most or all of said underportions, of said backside warp yarn, preferably at least 25%, at least 50%, at least 75%, at least 80%, at least 90%, or all of said backside warp yarns, form loose loops on the back of the fabric, preferably due to having a different weave tightness, different shrinkage ratios and/or being woven with different tensile tension for realizing a fabric with a draft ratio. The loose loops on the backside of the woven fabric can preferably be formed because of mechanical properties of the frontside warp yarns and the backside warp yarns and/or because of thermal properties of the frontside warp yarns and/or the backside warp yarns. Mechanical properties of the warp yarns can relate, for example, to their respective tensile tension during weaving, their respective weave tightness, or the like. Thermal properties of warp yarns can relate for instance to their respective shrinkage ratio due to washing.

In a preferred embodiment of the disclosure, in particular for at least 25%, at least 50%, at least 75%, at least 80%, at least 90% or all of the warp yarns, the frontside warp yarns, in particular most or all of frontside warp yarns, are woven with a first tensile tension and the backside warp yarns, in particular most or all of the backside warp yarns are woven with a second tensile tension lower than the first tensile tension. Thereby, a draft ratio is defined by the difference of the first tension on the frontside warp yarn in relation to the second tension on the backside warp yarns during weaving. The warp yarns for weaving a fabric with a draft ratio can consist of same material and/or structure, including thickness. The woven fabric according to the preferred embodiment of the disclosure may be woven with, particularly most or all of, the frontside warp yarns being pre-stretched according to the first tension, while the backside warp yarns, preferably most or all of the backside warp yarns, are not stretched or are pre-stretched according to the second tension lower than the (first) one of the frontside warp yarns. Preferably, the draft ratio equals a difference of tensile tension of the frontside warp yarns and the backside warp yarns, preferably between 5% and 50%, in particular 10% to 25%.

Preferably, frontside warp yarns, in particular all or most of the frontside warp yarns, comprise or consist of an elastic yarn preferably comprising elastane. Preferably, backside warp yarns comprise or consist of a rigid yarn, which may also be referred to as an inelastic yarn. An inelastic yarn can be described as not being capable of being stretched beyond a maximum length without permanent deformation, said maximum length being less than 1.05 times, preferably less than 1.02 times, of its original length; or not at all. Typical material for an inelastic or filament are: natural fibers, such as cotton or wool, polyester, nylon, etc. Elastic yarns can be described as being capable of being elastically stretched, for example for around 10% to around 25% of their original length. The initial or original length of the yarn can be measured while essentially no tensile tension is applied. An elastic yarn, which can be called a stretch yarn and which may be used for weft picks, frontside warp yarns and/or backside warp yarns, may consists of or comprise T400, spandex or elastane, as for instance Lycra® made by Invista. Preferably, an elastic yarn is a composite yarn comprising at least one inelastic filament and at least one elastic filament consisting of T400, spandex or elastane, as for instance Lycra® made by Invista.

In a preferred embodiment of a fabric according to the disclosure, a sum of a number of over portions and under portions of one warp yarn, which can be either a frontside warp yarn or a backside warp yarn, in relation to the number of picks bypassed by said over portions and under portions, defines that yarn's weave tightness. The fabric is woven such that the plurality of frontside warp yarns, preferably most or all of the frontside warp yarns, has a greater weave tightness than the plurality of backside warp yarns, preferably than most or all of the backside warp yarns. The term "higher weave tightness" shall be understood in that one type of the warp yarns, preferably the frontside warp yarns, makes more ups and downs between the picks than the other (backside) warp yarns do. Ups and downs mean that the warp comes up to the front of the fabric and, after passing the picks (defining an over portion) goes down to the back of the fabric (the front of the fabric being the visible side and the back being the side facing the user of an article or the garment obtained from or including the fabric). Preferably, for the same unitary length of fabric in warp direction, the number of up and down changes of the frontside warp yarns is larger than the number of up and down movements of the backside warp yarns.

After weaving, the warp yarns and picks are not straight anymore, but corrugated. This effect can be referred as to crimping, and, depending on the yarn that it relates to, either as warp crimp or weft crimp. For example, 100 cm of a straight warp yarn will always be woven to a fabric length of less than 100 cm, for example 98 to 89 cm. The shorter length of the woven fabric in warp direction with respect to the original length of the warp yarn can be referred to as crimp ratio. The crimp ratio depends on the diameters of the warp yarns and picks, the densities of the warp yarns and the picks, as well as on the weaving pattern. If the warp yarn changes up or down for every successive pick, a 1:1 weave pattern would be realized which would result in the maximum corrugation or maximum warp crimp. Such a warp moving up and down with respect to each successive pick realizes the maximum possible weave tightness (a 6/6 weave tightness with respect to the example further detailed below in this paragraph). In the fabric according to the disclosure, the frontside warp yarn may have such a high weave tightness. If a warp loop yarn for example defines a regular pattern having alternating over portions bypassing one pick and under portions bypassing five picks (which may be called 1/5 weave pattern), the weave tightness would be much less, in this example 2/6. Preferably, the material of the frontside warp yarn and/or the backside warp yarn is a stretch material.

In case of frontside warp yarns having a weave tightness of 1 and backside warp yarns having a weave tightness of approximately 0.3, as in the above example, due to the differences in weave tightness, the warp yarns could, from an original straight length of about one 100 cm, lead to a length in the woven fabric of about 90 cm. The tighter frontside warp yarn would crimp to about 90 cm and the backside warp yarn would crimp to about 97 cm. Due to this, the backside warp yarns would form loose, droopy loops at the back of the woven fabric for the surplus of 7 cm in this example. Generally, if the frontside warp yarns and the backside warp yarns consist of the same material or materials which behave very similar to one another, loose loops can be formed at the back of the fabric to provide a knitted-like feeling. Using different materials can enhance the effects leading to the knitted-like feeling.

In a preferred embodiment of the disclosure, which can be applied by itself or combined with the aforementioned preferred embodiment, in particular for at least 25%, at least 50%, at least 75%, at least 80%, at least 90% or all of the warp yarns, the plurality of frontside warp yarns, preferably all or most of the frontside warp yarns, have a shrinkage ratio which is at least the same as that of the plurality of backside warp yarns, preferably than all or most of the backside warp yarns. Preferably, the frontside warp yarns have a greater shrinkage ratio than the backside warp yarns. In particular, the shrinkage ratio of the frontside warp yarns is at least 5% higher, preferably 25% to 40% higher, more preferably 30% to 35% higher, than the shrinkage ratio of the backside warp yarns. In order to enhance the formation of loose, droopy loops on the back of the fabric, so as to achieve a knitted-like feeling, different materials can be selected for the frontside warp yarns than for the backside warp yarns, wherein the shrinkage ratio of the backside warp yarns is preferably selected to be lower than the shrinkage ratio of the frontside warp yarns. When the woven fabric is shrunk, for example when taking the woven fabric off the loom or/and when washing the woven fabric for the first couple of times, the frontside warp yarns shrinks more than the backside warp yarns so that the under portions or loop portions of the backside warp yarn in relation to the under portions of the frontside warp yarn become larger. Thus, by selecting appropriate materials for the frontside warp yarns and for the loop warp yarns or backside warp yarns, the formation of loose, droopy loops on the back of the fabric can be intensified. It is possible to combine the loop-formation-effect of using different weave tightnesses for the warp yarns and that of using materials having different shrinkage ratios and possibly other means.

The shrinkage ratio of a warp yarn can be determined according to the following method: As the shrinkage ratio of a single yarn, especially of a single elastic yarn, is very difficult to measure, the shrinkage of a yarn is measured by means of skeins. A skein comprises multiple individual threads of the same yarn; for example the yarns taken from one package or lot. A skein, for example such as described in ASTM D 4849, is obtained by using a motor-driven reel having a nominal perimeter of 60 centimeters. 80-wrap skein comprising 160 individual (warp) yarns are reeled with uniform tension of not over 1 cN/tex or 0.1 gf/den. The yarn is smoothly wound on the reel, the beginning and trailing ends of the skein are loosely tied. The prepared skeins for testing are conditioned for at least four hours by 20° C.±2° C. and 65% relative humidity ±2%. A tension force corresponding to 0.2 cN/tex or 0.02 gf/den can be calculated using Eq 1 or Eq 2:

$$\text{Tension force, cN}=0.2*N*T \quad \text{(Eq1)}$$

$$\text{Tension force, gf}=0.02*N*D \quad \text{(Eq2)}$$

where:

N=number of individual warp yarns; that is twice the number of wraps in the skein, T=yarn number, tex, and D=yarn number, denier.

The skein-loop-length of each conditioned skein is measured. The conditioned skein from a hook is hung at the top of the measuring scale with the inside of the top of the skein and the zero index of the scale. A second hook is hung on the bottom of the skein and sufficient mass (including the mass of the hook) is added to produce the force calculated in Equation 1 or 2. After 30 s±3 s, the inside length of the skein is measured to the nearest 1 mm and a 25 cm distance is measured and marked with permanent pen. The mass of the hooks and of the weight should be known in 1 part to 1000. The skein-loop-length of each skein is recorded. Each skein is twisted into a shape "8" and the individual yarns are brought together to form a two-coil loop. The procedure is repeated to form a four-coil loop. Each skein is wrapped carefully in cheesecloth and the cheesecloth is secured (sewed, tied) to prevent the entanglement of the yarn in actively boiling water. A distilled or demineralized water bath is made up, which is at least 40 times the mass of the wrapped skeins, and contains a 0.05%±0.005% solution of wetting agent by weight. The bath is brought to a continuously rolling boil and the skeins are immersed for 30 minutes±2 minutes. The bath is allowed to cool to at least 50° C. before decanting the solution from the specimens. The bath shall not be cooled by overflowing or rinsing the specimens, because the wetting agent will serve as a lubricant for the strands in making the final length measurement. A centrifuge or roll wringer is used to damp dry the wrapped skeins. The skeins are removed from the cheesecloth and they are complete dried at room temperature or for 1 h±5 minutes in a drying oven at 65° C.±3° C. Each dried skein is reconditioned in the standard atmosphere four hours for testing textiles. The distance between the permanent pen markings (originally distanced 25 cm) is remeasured by using the same procedure as described above to the nearest 1 mm, including using the same weight as before (calculated by Equation 1 or 2). The measurements are recorded as the final length. The shrinkage of each skein is calculated to the nearest 0.1% using Eq 3:

$$\text{Shrinkage, \%}=100(A-B)/A \quad \text{(Eq3)}$$

where:

A=25 cm (ororiginal skein-loop-length of each skein), and

B=re-measured mark distance (or final skein-loop-length of each skein).

When B is greater than A due to the elongation of the skein, a "negative" shrinkage is reported as extension.

The calculated shrinkage of a skein is assumed to equal the shrinkage ratio of the individual warp yarns of the skein.

The overall shrinkage ratio of a woven fabric, particularly including the shrinkage ratio due to the warp yarns' materials in addition to the effects achieved by having different weave tightnesses, preferably amounts to 40% of the original warp length. The overall shrinkage ratio of a woven fabric can be determined by a comparison of measurements with respect to a sample fabric before and after washing. The fabric can first be conditioned at a predefined temperature and humidity, for example for at least sixteen hours by 20° C.±2° and 65% relative humidity±2%. Samples, for instance of a size of 60×60 cm can be cut from the fabric. Such samples should be taken at least 15 cm away from the selvedge. A box of 4 sides of 40 cm (L1) can then be marked on the fabric samples. One side of the box should be arranged approximately parallel to the warp direction and the other side is approximately parallel to the weft direction. The samples are then to be laundered in a washing machine together with further fabric. The total washing machine load can be about 2 kilograms of air-dried material, no more than half of which should consist of the test samples. The laundry shall be gently washed with a water temperature of 40° C. A detergent amount of 1 g/l to 3 g/l can be used, depending on the water hardness. The samples are then to be laid on a flat surface until they are dried and then to be conditioned again for 60 hours at 20° C.±2° and 65% relative humidity ±2% relative humidity. The size of the above-mentioned box of 4 sides can then be measured again (L2). The shrinkage after laundering can then be calculated using equation 4 (Eq 4):

$$C\%=(L1-L2)/L1\times 100, \quad \text{(Eq 4)}$$

where L1 is the original distance between the marking of 40 cm and L2 is the distance after washing and drying. The results are averaged for multiple samples and reported for both weft and warp direction. A shrinkage number larger than 1 reflects an extension which can exceptionally occur due to the behavior of certain yarns.

According to a preferred embodiment of the disclosure, in particular for at least 25%, at least 50%, at least 75%, at least 80%, at least 90% or all of the frontside warp yarns, said over portions, in particular most or all over portions, of one of the plurality of frontside warp yarns bypass 1 to 5 picks, preferably 2 to 4 picks. It is most preferred that the over portion of the frontside warp yarn is bypasses exactly 3 picks so as to realize a typical denim-fabric-optic. In other preferred embodiments, denim-fabric-like-optics can be achieved by over portion of the frontside warp yarn passing by exactly 2 or exactly 4 picks.

A preferred embodiment of the disclosure comprises at least as many frontside warp yarns backside warp yarns. Preferably, the number of frontside warp yarns is exactly two or exactly three times as high as the number of backside warp yarns. When using a larger number of frontside warp yarns with respect to the number of backside warp yarns, the woven fabric can easily be designed such that the frontside warp yarns dominate the visual appearance of the front of the fabric. For a woven fabric that shall look like denim, it can be preferred that a repeating pattern of four frontside warp yarns and one backside warp yarn are selected. In a further development of the disclosure, the backside warp yarns can be thicker or bulkier than the frontside warp yarns, in particular for woven fabrics that have many more frontside warp yarns than backside warp yarns. In this case, a knitted-like behavior of the back of the fabric can be achieved in spite of using only a low number of backside warp yarns. In accordance with an embodiment of the disclosure, in particular for at least 25%, at least 50%, at least 75%, at least 80%, at least 90% or all backside warp yarns, said over portions bypass less picks than said under portions of one, preferably most or each one, of the plurality of backside warp yarns. In particular for at least 25%, at least 50%, at least 75%, at least 80%, at least 90%, or all of the threads of backside warp yarns, preferably most or all of the over portions no more than four picks, preferably exactly one pick.

In a preferred embodiment of the disclosure, in particular for at least 25%, at least 50%, at least 75%, at least 80%, at least 90% or all warp yarns, one of the plurality of backside warp yarns, preferably each one or most of the plurality of backside warp yarns, is arranged in the weft direction immediately adjacent to at least one frontside warp yarn, preferably to two frontside warp yarns. In other words, in this preferred embodiment, a weft yarn bypasses a frontside warp yarn, then a backside warp yarn and then possibly another frontside warp yarn. The frontside warp yarns are in particular arranged at least sectionally in front of an adjacent backside warp yarn. By providing each backside warp yarn with at least one frontside warp yarn next to it in weft direction, the woven fabric can be created with an arrangement that shows on its front mostly frontside warp yarns. If each backside warp yarn has two immediately adjacent frontside warp yarns, in weft direction, the warp yarns before and after any backside warp yarn are always frontside warp yarns. Preferably, the number of frontside warp yarn on one or both sides of a backside warp yarn in the weft direction can be larger than one. When considering the woven fabric according to this preferred embodiment in weft direction, all picks would always pass at least one frontside warp yarn, possibly more, between two successive backside warp yarns.

In a further development according to the disclosure, the over portions of the backside loop yarn, preferably most or all of the over portions of the backside loop yarn, in particular at least ½ or ⅓ of the over portions of the backside loop yarns, are hidden behind at least one, preferably two, over portions of the frontside warp yarns immediately adjacent in weft direction. By selecting the weave pattern such that the over portions of the backside warp yarn are rarely or never arranged immediately adjacent in weft direction to an under portion or two under portions of adjacent frontside warp yarn(s), possibly in conjunction with selecting a thicker frontside warp yarn with respect to the backside warp yarn, in the woven fabric according to this preferred embodiment of the disclosure, the backside warp yarns are hidden from sight by the frontside warp yarns even where they have over portions. Such an arrangement could be particularly advantageous if the backside warp yarns are of another color than the frontside warp yarns and/or the picks (or weft yarns), for example, if they are selected to be red or green to give the inside of a garment a particular color. For such a fabric, it is advantageous if most or all of the backside warp yarns' over portions are arranged such that they have one or two immediately adjacent over portions of the adjacent front yarn(s).

If the frontside warp yarn is woven with the weft yarn(s) in a regular weave, such as a 3/1 pattern, using a regular, for example 8/1, weave pattern for the backside warp yarn, sooner or later a backside warp yarn over portion would be arranged next to a frontside warp yarn under portion. A relatively easy way to avoid this is to make a local adjustment to the weave pattern of the backside warp yarn, for instance by using a 1/9 weave, possibly in conjunction with a 1/7 weave, to offset the backside warp yarns' over portion from the frontside warp yarns' under portion which would be arranged immediately adjacent to the backside warp yarns' over portion in the weft direction if a constant 1/8 weave pattern would be used.

In a preferred embodiment of the disclosure, in particular for at least 25%, at least 50%, at least 75%, at least 80%, at least 90% or all of the frontside warp yarns, said under portions, in particular most or all under portions, of one of the plurality of frontside warp yarns, in particular most or each one of the plurality of frontside warp yarns, bypass less picks than, in particular most or all of, said over portions of said frontside warp yarns. Additionally or alternatively, in particular all or most of, said under portions of one of the plurality of frontside warp yarns, in particular most or all of the plurality of frontside warp yarns, bypass no more than 4 picks, preferably exactly 1 pick. Such a weave pattern enhances a denim-like look of a fabric and establishes the frontside warp yarns as the most predominantly visible warp yarn on the front of the fabric while rendering the backside warp yarn nearly imperceptible. In a preferred embodiment of the disclosure, a ratio of picks bypassed by said under portions of one of the plurality of frontside warp yarns in relation to the picks bypassed by the over portions of said frontside warp yarns defines a visibility ratio which is 1:1 or less, preferably 1:2, 1:3, or 1:4, preferably, the visibility ratio applies to all under portions of each one of the frontside warp yarns.

A second aspect of the disclosure, which can be combined with the above-mentioned first aspect of the disclosure and all embodiments thereof, relates to a woven fabric, particularly a warp faced fabric, such as a denim fabric. According to the second aspect of the disclosure, the woven fabric comprises a front and a back and a plurality of picks extending in weft direction and a plurality of warp yarns comprising or consisting of frontside warp yarns and backside warp yarns extending in warp direction. The plurality of warp yarns extends in warp direction and bypass picks at their front side to define over portions and bypass picks at their back side to define under portions, wherein said plurality of warp yarns comprise frontside warp yarns and backside warp yarns. At a connecting point, the frontside warp yarn bypasses one or more picks, preferably exactly one pick at its/their back side. The backside warp yarn bypasses one or more, preferably exactly one, pick at its/their front side at a connecting point.

According to the second aspect of the disclosure, said frontside warp yarns and said backside warp yarns are designed and/or woven, preferably differently designed and/or differently woven, such that under portions, or loop portions, of the backside warp yarns extend looser than the under portions of said frontside warp yarns. The under portions of the backside warp yarns can extend curved, in particular more curved than the frontside warp yarn's under portions. The under portions of the frontside warp yarns can extend straight, in particular straighter than the under portions of the backside warp yarns. A loose loop easily identified in a woven fabric in that the length of the backside warp yarn forming the under portion or loop portion is larger than the distance between the connecting points or over portions between which said loose loop under portion extends. The length of the backside warp yarn along the loose loop is preferably at least 25%, at least 50%, at least 75% or at least 100% larger than the distance between the connecting points between which said loose loop extends. The distance between the connecting points framing one loose loop can be determined by measuring the distance between the respective contact surfaces of those weft yarns where the backside warp yarn passes from its under portion (or loop portion) to an neighboring over portion. The loose loops of the backside warp yarn can be formed after the woven fabric is taken off the loom or after a first or first couple of washings of the fabric. In the loose loops, the of the respective warp yarn tension after removal from the loom and/or after washing can be much less than in the frontside warp yarns that do not comprise loose loops. Preferably, the tension in the frontside warp yarns and/or the weft yarns of the woven fabric according to the second aspect of the disclosure is at least as high, particularly higher than, the tension in the backside warp yarns, in particular during weaving and/or before the fabric is taken off the loom and/or before washing for the first time. The formation of loose loops can be achieved or enhanced for example by selecting a backside warp yarn having a lower shrinkage ratio than the frontside warp yarns and/or for example by weaving the frontside warp yarns with a higher weave tightness than the backside warp yarns.

A third aspect of the disclosure, which can be combined with the first and/or the second aspect of the disclosure, as described above, relates to a woven fabric, particularly a warp faced fabric, such as a denim fabric. The woven fabric according to the third aspect of the disclosure comprises a front and a back, a plurality of picks extending in weft direction and a plurality of warp yarns extending in warp direction. The plurality of warp yarns extend in warp direction and bypass picks at their front side to define over portions and bypass picks at their back side to define under portions, wherein said plurality of warp yarns comprise frontside warp yarns and backside warp yarns.

In the third aspect of the disclosure, the frontside and backside warp yarns are differently designed and/or woven such that the frontside warp yarns, in particular at least 25%, at least 50%, at least 75%, at least 90% or all of the front side warp yarns, in particular are laterally in contact with each adjacently neighboring frontside warp yarn, form a closely woven frontside warp yarn arrangement. Laterally, regarding the arrangement of frontside warp yarns, refers to the weft direction. Preferably, in the woven fabric according to the third aspect of the disclosure, the frontside warp yarns are constantly and/or continuously in contact with each other along at least 50%, at least 75%, at least 90% or all of their length in warp direction. It shall be clear that two neighboring warp yarns that are in lateral contact with one another can, preferably at regular intervals, have picks of weft yarn pass between their contacting side, whenever a pick passes from the back of the fabric to the front of the fabric between the neighboring warp yarns, which naturally occurs in most weaving patterns. When both lateral sides of the frontside warp yarn in weft direction (horizontal right and horizontal left) are in contact with a respective immediately adjacent warp yarn in weft direction, the realized arrangement of frontside warp yarns is very closely woven and structurally isolate the backside warp yarns from the front of the fabric, wherein in particular the frontside warp yarns adjacent to each other in the weft direction are laterally in contact with each other. Such a closely woven frontside warp yarn arrangement can be achieved or enhanced for example by using frontside warp yarns that are thicker than backside warp yarns or by arranging the frontside warp yarns in a first warp yarn plane and the backside warp yarns in a second warp yarn plane, such that the first warp yarn plane is offset from the second warp yarn plane towards the front of the fabric. The frontside warp yarns adjacent to each other in the weft direction are preferably arranged laterally in contact with each other after the first or the first couple of washings of the woven fabric according to the third aspect of the disclosure.

In a further development of the third aspect of the disclosure, the frontside warp yarns have axial center lines and define a central warp/weft plane extending through the axial centerlines of the frontside warp yarns along the over portions of the frontside warp yarns, wherein all of the backside warp yarns have axial centerlines and wherein most or all of the backside warp yarns have axial central lines particularly along their entire extension in warp direction extending on the back side of the central warp/weft plane, preferably towards the back of the woven fabric, in a thickness direction perpendicular to the warp direction and perpendicular to the weft direction. The central warp/weft plane is spanned in warp direction and in weft direction. The central warp/weft plane, defined by particularly the over portions of the frontside warp yarns, is particularly apparent when the woven fabric of the third aspect of the disclosure is on the loom and/or when tension is applied to the woven fabric in the warp direction.

Generally, a wide variety of materials can be chosen from selecting the warp yarns and weft yarns for a woven fabric according to the disclosure.

In order to modify the width and/or the elasticity of a woven fabric, picks (weft yarns) of a predetermined shrinkage ratio and/or elasticity can be selected. This enables the manufacturer to predetermine the elasticity in weft direction and the width of the fabric.

After weaving, but before washing, the fabric according to the disclosure can in a preferred embodiment be woven such that the fabric comprises a warp density between 15 and 100 warps/cm. After weaving, but before washing, the fabric according to the disclosure can in one preferred embodiment have a fabric structure which comprises a weft density between approximately 2 and 60 wefts/cm. A first preferred range for a particularly loose weaving can have a weft density between approximately 2 and 20 wefts/cm. A second preferred fabric can comprise a weft density between 10 and 60 wefts/cm.

In a preferred embodiment of the disclosure, the weft yarns can be chosen from yarns having an English cotton number between approximately Ne 4 and Ne 69 (about 55 to 1350 denier). In a preferred embodiment of the disclosure, the frontside warp yarns have an English cotton number of 20±5 or 20±2, in particular exactly 20, and the backside warp yarns have an English cotton number of 30±5 or 30±2, in particular exactly 30. In a preferred embodiment of the disclosure, the warp yarns can be chosen from yarns having an English cotton number between approximately Ne 6 and Ne 60 (about 80 to 900 denier). Yarns can be classified for example using the denier (den.) system or using the English cotton yarn number (Ne). While the denier numbering system is most often used for synthetic fibers whereas the English cotton yarn number is typically used for cotton and the like, the skilled person will know how to convert from one numbering system to the other.

The woven fabric according to the disclosure can have warp yarns that are chosen from the following materials: cotton, polyester, viscose, acrylic, wool, linen, silk, rayon and combinations thereof, and may also include elastomeric or non-elastomeric groups such as nylon, PBT, bicomponents, spandex, T400, etc.

In a preferred embodiment of the disclosure, the warp yarns can be chosen from yarns that are raw, sulphur, dyed, reactive dyed, indigo (ring) dyed, pigment dyed, direct dyed, indanthrene dyed, acid dyed, natural dyed, etc. Preferably, the backside warp yarn material can be cotton lycra, colored or raw. The material for the frontside warp yarns is preferably cotton lycra or cotton dualcore (a combination of cotton, lycra and polyester for better recovery). A preferred elastane material for the frontside warp yarns and/or the backside warp yarns is Lycra® from the company Invista and/or Dorlastan® from Bayer AG. In particular, the frontside warp yarns are indigo (ring) dyed. Preferably, the backside warp yarns and/or the picks (weft yarns) are not indigo dyed, in particular undyed.

The woven fabric is according to the first, second or third aspect of the disclosure preferably included in a textile article, preferably an article of clothing. A preferred embodiment of the disclosure relates to an garment or article of clothing comprising or consisting to at least 25%, at least 50%, at least 75% or 90%, preferably entirely, of a warp faced woven fabric as described herein and of non-textile pieces, such as a zipper, buttons, rivets or the like.

The disclosure also relates to a method for producing a woven fabric, preferably a warp-faced fabric, such as a denim fabric. The method can preferably be used for producing a woven fabric according to the disclosure in the first, second and/or third aspect or a preferred embodiment thereof as described above. The method according to the disclosure comprises the steps: providing at least one weft yarn for weaving picks and warp yarns; weaving the fabrics such that the warp yarns form over portions bypassing picks at their frontside and under portions bypassing picks at their back side, wherein a plurality of frontside warp yarns and backside warp yarns are realized in that the under portions of the frontside warp yarns bypass a lower number of picks than the under portions of backside warp yarns; and preferably shrinking the woven fabric, wherein the under portions of the loop yarns form loops on the back of the fabric. It shall be clear that providing weft yarn shall include the provision of at least one thread weft yarn but can also include the provision of two or more threads weft yarn which are woven through the warp yarns. While the above description describes warp yarns as bypassing picks, it shall be clear that during weaving, the individual picks of weft yarn move through the warp yarns which are attached to the loom. It shall therefore be clear that the term "bypassing" is used herein with respect to the structure of the woven fabric that is produced rather than in relation to the movement of warp yarns and weft yarn(s) relative to one another.

In a preferred embodiment of a method according to the disclosure, providing the warp yarns comprises selecting different materials for the frontside warp yarns than for the backside warp yarns, in particular such that the frontside warp yarns have at least the same shrinkage ratio as the backside warp yarns, preferably a greater shrinkage ratio than the backside warp yarns. The difference in shrinkage ratios can in particular be selected as described above.

In a preferred embodiment of a method according to the disclosure, the fabric is woven such that the frontside warp yarns are at least sectionally arranged in front of the backside warp yarns during weaving and/or during shrinking. In other words, the method for producing the woven fabric according to the disclosure can be realized such that the backside warp yarns are arranged in particular in the fabric's thickness direction behind (or: towards the back side of the fabric with respect to) the frontside warp yarns while they are still on the loom. It is also possible that the backside warp yarns and the frontside warp yarns are arranged essentially in the same plane while they are still on the loom but become arranged such that the frontside warp yarns are at least sectionally in front of the backside warp yarns after the woven fabric has been removed from the loom, preferably during shrinking.

In a preferred method according to the disclosure, the fabric is woven such that, after the woven fabric is removed from the loom, and preferably before the woven fabric is washed and/or finished, the woven fabric has a weft density between 2 weft yarns/cm and 60 weft yarns/cm. For a particularly loosely woven fabric, the fabric can be woven such that it has a weft density between 2 weft yarns/cm and 20 weft yarns/cm. A relatively more dense fabric can be woven such that it has a weft density between 10 weft yarns/cm and 60 weft yarns/cm.

In a further aspect of a method according to the disclosure which can be combined with the method described above, for producing a woven fabric, preferably a warp faced fabric, such as a denim fabric, in particular a fabric, as described above, using the steps: providing at least one weft yarn for weaving picks and warp yarns; weaving the fabrics such that the warp yarns form over portions bypassing picks at their front side and under portions bypassing picks at their back side, wherein a plurality of frontside warp yarns and backside warp yarns are realized in that. In the method according to this further aspect of the disclosure, the warp yarns are selected and/or woven, wherein preferably the frontside warp yarns are selected and/or woven differently than the backside warp yarns, such that said under portions of the backside warp yarns are looser than the under portions of the frontside warp yarns, particularly after the first or the first couple of washings, preferably forming loops extending at the back between the connecting points of said backside warp yarns. For example, the loops can be formed because of weaving the frontside warp yarn and the backside warp yarn with different tensile tensions, resulting in a woven fabric that has a draft ratio in the warp direction. The tensile tension in the warp yarns during weaving can be set for instance by using individual rollers, along which one or more warp yarns pass, for tensioning said one or more warp yarn. The tensile tension in the warp yarns during weaving can alternatively be set for example by providing the frontside warp yarns to the loom at a different (lower) speed than the backside warp yarns.

In yet another aspect, the disclosure relates to a method, which can be combined with either one of the above-mentioned methods, for producing a woven fabric, preferably a warp faced fabric such as a denim fabric, in particular as described above, comprising the steps: providing at least one weft yarn for weaving picks and warp yarns; weaving the fabrics such that the warp yarns form over portions bypassing picks at their front side and under portions bypassing picks at their back side, wherein a plurality of frontside warp yarns and backside warp yarns are realized. In the method according to this aspect of the disclosure, the warp yarns are selected and/or woven, wherein preferably the frontside warp yarns selected and/or woven differently than the backside warp yarns, such that the frontside warp yarns, preferably at least 25%, at least 50%, at least 75%, at least 90% or all of the frontside warp yarns, form a closely woven frontside warp yarn arrangement and structurally isolating the backside warp yarns from the front of the fabric, wherein in particular the frontside warp yarns adjacent to each other in the weft direction are laterally in contact with each other.

With respect to all of the above-mentioned aspects of the disclosure, the term "design" in relation to a warp yarn can relate to its material properties, such as an English cotton number, denier count, thickness, weight, material, material composition, elasticity, shrinkage ratio, or the like. A selection of warp yarns can be made depending on its design.

It shall be clear that for a fabric in accordance with the disclosure, the most favorably results are achieved when the entire fabric comprises warp yarns consisting exclusively of frontside warp yarns and backside warp yarns as described above. However, woven fabrics that have a smaller number of frontside warp yarns and/or backside warp yarns as described herein can benefit from the effects provided by the disclosure to an albeit limited extend. It is preferred that the warp yarns of the woven fabric consist to at least 80% or at least 90% of frontside warp yarns and backside warp yarns. It is less preferred that the warp yarns of the woven fabric consist to at least 75% of frontside warp yarns and backside warp yarns.

Similarly, when the fabric is woven, it is preferred that the fabric has a constant weave pattern in which the over portions and the under portions of frontside warp yarns and backside warp yarns are arranged in a constant or an at least periodically repetitive weave pattern. Therefore, it is preferred that the woven fabric comprises warp yarns having under portions and over portions which are mainly, that is: to at least 50%, arranged as described herein. That is to say that the majority of the under portions and over portions of a backside warp shall be arranged with respect to the picks as described herein. Similarly, it is preferred that most, if not all of the over portions and under portions of the frontside warp yarns are arranged as described herein with respect to the picks.

FIGS. 1 through 3, 5*a*, 5*b* and 7 show different views of the same embodiment of a warp faced woven fabric 1 according to the disclosure. While FIG. 1 shows a view onto the front 2 of the woven fabric 1, FIG. 2 show the back 3 of the woven fabric 1. In FIGS. 2*a*, 6*a*, and 6*b*, the first visible pick 6* or 6''' is colored in black for illustrating purposes only, in order to simplify the description with respect to the disclosure. The black highlighting of the picks 6* or 6''' shall particularly not indicate that the highlighted pick differs in any significant way from the other picks 6, in particular not in its color or in the material chosen for the pick 6* or 6'''.

The warp faced woven fabric 1 shown in FIGS. 1 through 3 consists of picks 6, frontside warp yarns 4 and backside warp yarns 5, which can also be called loop warp yarns. The woven fabric 1 has a very regular weave pattern, in which the frontside warp yarns 4 are woven with the picks 6 such that a 3/1 body weave, which is very common for denim, is being realized. In the shown fabric 1, when going along a pick 6, such as the pick 6* which is highlighted in FIG. 2*a*, three consecutive frontside warp yarns 4 are arranged at the frontside 62 of the pick 6* and the fourth consecutive frontside warp yarn is arranged at the back side 63 of the pick 6*. This pattern repeats along the pick 6*. The pick 6* also extends over backside warp yarns 5, but only every ninth backside warp yarn 5 is arranged at the frontside 62 of the pick 6*.

Whenever a frontside warp yarn 4 bypasses one or more picks 6 frontside, said frontside warp yarn 4 defines a so called over portion 43. Whenever a frontside warp yarn 4 bypasses the back side 63 of a pick 6, said frontside warp yarn 4 realizes the so called under portion 41.

Whenever a backside warp yarn 5 bypasses one or more picks' front side 62, said backside warp yarn 5 defines an over portion 53. Whenever a backside warp yarn 5 bypasses the back side 63 of a pick 6, said backside warp yarn 5 realizes an under portion 51 or loop portion.

In the woven fabric 1 as shown in FIGS. 1 through 3, every single backside warp yarn 5 is, in weft direction, neighbored by frontside warp yarns 4. Furthermore, the pattern of frontside warp yarns 4 and backside warp yarns 5 is a regular 2/1 pattern, such that, in weft direction, each pick 6 bypasses two consecutive frontside warp yarns 4 and then one backside warp yarn 5. It is easily recognized when looking at FIG. 1, that the backside warp yarns 5 will be barely visible in the warp faced woven fabric 1, because, for the largest amount, they are hidden behind the frontside warp yarns 4 and the picks 6. Only at the rarely occurring loop-over portions 53 are the backside warp yarns 5 visible at the front 2 of the woven fabric 1.

The back 3 of the woven fabric 1, on the other hand, shows mostly loop warp yarns 5, while the frontside warp yarns 4 remain almost imperceptible and can only be seen at the frontside warp-under portions 41. To the largest extent, the back 3 of the fabric 1 is, however, made of under portions 51 or loop portions of the backside warp yarn 5. It is noticeable that the under portions 51 of the backside warp yarns 5 are much larger than the under portions 41 of the frontside warp yarns 4. The under portions 51 of the backside warp yarns 5 are also much larger than the over portions 53 of the backside warp yarns 5. When looking at FIG. 2, particularly at the warp yarn that is indicated as 5* (but does otherwise not differ from the other backside warp yarns 5) it becomes apparent that the loop portions 51 bypass eight picks 6 at their back side 63. Between two adjacent backside warp yarn under portions 51, the backside warp yarn 5 (5*) bypasses a single weft 6 at its frontside 62 and forms an over portion 53 which can be called a connection portion.

When looking at FIGS. 2*b* and FIG. 1, particularly at the frontside warp yarns indicated as 4' or 4* (which are otherwise identical to the other frontside warp yarns 4), it can be seen that each frontside warp yarn 4 bypasses three consecutive picks 6 at their frontside 62 and then bypasses one single pick 6 at its back side 63. This arrangement of the frontside warp yarns 4 with respect to the picks 6 creates a weave pattern in which the frontside warp yarns 4 have larger over portions 43 than under portions 41. The over portions 43 of the frontside warp yarn 4 are, however, smaller than the under portions 51 of the backside warp yarn 5. The term "larger" with respect to the size of under portions or over portions is used herein with respect to the number of picks 6 which are bypassed by the respective under portion or over portion of a warp yarn 4 or 5.

It shall be clear that FIGS. 1 through 3 shall be understood to be schematically, as all of the warp yarns 4, 5 shown in the figures extend perfectly straight, which they do not do in a woven fabric that is no longer attached to a loom or subjected to tensile tension in warp direction. As soon as the woven fabric is detached from the loom, the warp yarn would define a roughly sinusoidal path with respect to the picks so that both the picks and the warp yarns of an actual woven fabric would have a somewhat sinusoidal path. The straight warp yarns shown in FIGS. 1 through 3 shall be understood to be schematic simplifications for a better understanding of the disclosure.

In FIG. 3, a central warp/weft plane C is indicated which is defined by the central axes A of the frontside warp yarns 4. The frontside warp yarns 4 are arranged at the front 2 of the fabric whereas the backside warp yarns 5 are arranged towards the back 3 with their axes B behind the central warp/weft plane C. For a person looking onto the front 2 of a fabric 1, only the picks 6 and the frontside warp yarns 4 would be perceptible, whereas the backside warp yarns 5 would be hidden behind frontside warp yarns 4 and picks 6. Due to the fact that in the woven fabric 1 according to the disclosure, the loop warp yarns 5 according to the embodiment shown in FIGS. 1 through 3 have under portions 51 which are much larger than the over portions 53 of the backside warp yarns 5 and also larger than the over portions 43 of the frontside warp yarns 4, the picks 6 and the frontside warp yarns 4 force the backside warp yarns 5 towards the back 3 of the fabric 1. With respect to the central plane C extending in weft direction and warp direction and being arranged centrally in the woven fabric 1 with respect to its thickness direction T, the backside warp yarns 5 are arranged towards the back 3 of the fabric, behind the central plane C, whereas the frontside warp yarns 4 are arranged towards the front 2 of the fabric and define a central warp/weft planeC through the extension of their axial axes A in their over portions 43. The thickness direction or transversal direction T extends perpendicular to the horizontal of weft direction H and extends perpendicular to the vertical or warp direction V.

When looking at the woven fabric 1 in warp direction, for a given number of picks, for example 36 picks, the total number of over portions 43 and under portions 41 of a frontside warp yarn 4 is larger than the under portions 51 and over portions 53 of a backside warp yarn 5. This is due to the fact that the frontside warp yarns 4 have relatively shorter over portions 43 with respect to the under portions 51 of the loop warp yarn 5, while the size of the backside warp yarns' over portions 53 and the size of the frontside warp yarns' under portions 41 is equal to one. Thus, for a sample of 36 wefts (defining a unitary length in warp direction), each loop yarn 5 has four under portions 51 and four over portions 53, whereas each frontside warp yarn 4 has nine under portions 41 and nine over portions 43. The relation of the total number of under portions and over portions of a single warp yarn (4 or 5) with respect to the picks 6 passed by that warp yarn (4 or 5) can be used to determine that warp yarn's weave tightness. In case of the woven fabric 1 as shown in FIGS. 1 through 3, the weave tightness of the frontside warp yarn is ½ ((9+9)/36) whereas the weave tightness of the backside warp yarns 5 is about 0.22 ((4+4)/36). When a woven fabric is taken off the loom, the woven fabric experiences certain shrinkage because, as explained above, the warp yarns will change from their almost perfectly straight orientation to a roughly sinusoidal path. The shrinkage due to this effect increases dependent upon the weave tightness.

In the woven fabric 1 according to an embodiment of the disclosure, the frontside warp yarns 4 preferably are woven such that they have a larger weave tightness than the backside warp yarns 5, so that, when the woven fabric is taken from the loom, the backside warp yarns 5 can relax in relation to the frontside warp yarns and form loops with the under portions 51 at the back 3 of the fabric. These loops create a knitted-like visual appearance and feeling on the back 3 of the woven fabric 1.

FIG. 4*a* shows a perspective view of the front and FIG. 4*b* shows a perspective view onto the back 3 of a woven fabric 10 after washing. The main difference of the woven fabric 10 in FIGS. 4*a* and 4*b* to the woven fabric 1 of FIGS. 1 through 3 is the thickness of the backside warp yarns 5 being smaller than the thickness of the frontside warp yarns 4. For illustrative purpose only, the frontside warp yarns 4 are colored in black.

In FIGS. 4*a* and 4*b*, the woven fabric 10 has been washed and the frontside warp yarns 4 and the backside warp yarns 5 have thereby been shrunk in accordance with their respective shrinkage ratio. The shrinkage ratio of the frontside warp yarns 4 is at least as large as the shrinkage ratio of the backside warp yarns 5 and can be larger. Since the weave tightness of the frontside warp yarn 4 is higher than the weave tightness of the loop or backside warp yarns 5 and because the shrinkage ratio of the frontside warp yarns 4 is larger than the shrinkage ratio of the backside warp yarns 5, the shrinkage process due to washing the fabric results in the backside warp yarns forming loose loops with their under portions 51 on the backside of the back of the fabric. These loose loops provide a soft, knitted-like feeling to the wearer of the warp faced woven fabric 10.

Although this is not immediately apparent in the schematic drawing of FIGS. 4*a* and 4*b*, the backside warp yarns 5 being thinner with respect to the thicker frontside warp yarns 4 enhance the effect of the frontside warp yarns 4 hiding the backside warp yarns 5 to a person looking at the front 2 of the fabric 10, thereby improving the denim-like look of the fabric 10. The backside warp yarns 5 of the fabric 10 are isolated from the front 2 of the fabric through the weft yarns 6 and frontside warp yarns 4.

FIGS. 5*a* and 5*b* show a cross sectional view of the warp faced woven fabric 1 in weft direction. As explained above, the frontside warp yarn 4 is woven with the picks 6 to realize a 3/1 weave pattern. In other words, the frontside warp yarn 4 is woven in a regular pattern comprising over portions 43 bypassing three picks 6 at their respective front side 62. Between two adjacent over portions 43, the frontside warp yarn bypasses one pick 6 on its back side 63 to form an under portion 41 or connecting point.

The backside or loop warp yarn 5 is woven in a 1/8 pattern so that between two adjacent over portions 53, where the backside warp yarn 5 bypasses one single pick 6, the backside warp yarn 5 bypasses eight picks at their back side 63.

Just as in FIGS. 1 through 3, both the frontside warp yarns 4 and the backside warp yarns 5 of FIGS. 4*a* and 4*b* are arranged in a constantly regular weave pattern. Due to this very regular pattern, which repeats every 4 picks for the frontside warp yarn 4 and every 9 picks for the backside warp yarn 5, every 36th pick has an backside-warp-yarn over portion 53 immediately adjacent in the weft direction to an under portion 41 of a frontside warp yarn 4 forming a visible spot 71. At such visibility spots 71, the backside warp yarn is relatively visible on the front 2 of the fabric 1. The remaining backside-warp-yarn-over-portions 53 are arranged such that the immediately adjacent frontside warp yarn 4 in weft direction forms an over portion 43, so that a hidden spot 73 is formed. In such hidden spots 73, although the backside warp yarn 5 passes on the front side 62 of the pick 6, the frontside warp yarns 4 immediately adjacent in weft direction can hide the backside warp yarn 5, particularly if the backside warp yarn 5 is thinner than the frontside warp yarns, as in the embodiment of FIGS. 4*a* and 4*b*.

In a preferred embodiment of the disclosure which is not illustrated in the drawings, the woven fabric has the frontside warp yarns 4 and backside warp yarns 5 arranged such that no visible spots 71 are formed. This requires that the weave pattern of the frontside warp yarn 4 or, preferably, the backside warp yarn 5, is not constant. In the embodiment shown in FIGS. 5*a* and 5*b*, the visible spots 71 could, for instance, be avoided by locally adjusting the weave pattern of the backside warp yarn 5, for example so that locally the weave pattern is not constant a 8/1 but one 7/1 weave pattern with one immediately adjacent 9/1 weave pattern. Other variations are possible which avoid the occurrence of common multiples. For example, the visible spot 71 could be avoided by using a backside warp yarn 5' having a regular weave pattern including three consecutive 8/1 weaves and then one 1/9 weave.

FIGS. 6*a* and 6*b* show a schematic woven fabric 100 according to a second embodiment of the disclosure which, similar to the woven fabrics 1 or 10, consists of frontside warp yarns 4, backside warp yarns 5 and picks 6. FIG. 5*a* shows the woven fabric 100 before shrinking, and FIG. 5*b* shows the same woven fabric 100 after shrinking, for example after washing the woven fabric 100 for the first time or for the first few times. In the woven fabric 100 as shown in FIGS. 6*a* and 6*b*, the frontside warp yarns 4 have a much larger weave tightness than the backside warp yarns 5. The weave tightness of the frontside warp yarns 4 is one, because the over portions 43 and the under portions 41 of the frontside warp yarn 4 both have a size of 1 and the frontside warp yarn 4 passes up and down from one pick 6 to the next. The frontside warp yarn 4 will always pass a back side 63 of one pick 6 and then the frontside 62 of the next pick 6, and so on.

The backside warp yarn 5 in the woven fabric 100, on the other hand, defines under portions 51 bypassing nine consecutive picks 6 between two adjacent over portions 53, so that a weave tightness of 0.20 is achieved. These weave tightnesses of the frontside warp yarn 4 and the backside warp yarn 5 by itself already leads to a significantly different overall shrinkage and thus to the formation of loops 51 at the back 3 of the woven fabric 100.

Additionally, for the woven fabric 100, different materials having a different shrinkage ratio are used for the frontside warp yarns 4 and the backside warp yarns 5. This shrinkage ratio of a warp yarn is essentially the ratio of the length of a single warp yarn after washing in relation to the same warp yarn's length before washing. If the frontside warp yarns 4 have a larger shrinkage ratio then the backside warp yarns 5, when the woven fabric 100 is washed for the first time or the first couple of times, the frontside warp yarns 4 shrink significantly more than the backside warp yarns 5, which enhances the formation of warp loops at the back 3 of the woven fabric 100. It shall be clear that the woven fabric 1 which was described above with relation to FIGS. 1 through 3 can also have different materials having different shrinkage ratios for the frontside warp yarns 4 and the loop warp yarns 5. Since the different weave tightnesses alone already leads to the formation of droopy warp loops 51, it is usually sufficient if the frontside warp yarns 4 and the loop warp yarns 5 have approximately the same shrinkage ratio.

The following charts comprises lists of preferred combinations of frontside warp yarns, backside warp yarns and weft yarns for realizing a woven fabric in accordance with the disclosure. The English cotton number Ne referred to shall be understood in also relating to all equivalent measurement units.

| | Frontside Warp Yarn | Warp-2 | Weft Picks | Warp Density (warps/cm) | Weft Density (wefts/cm) | Warp Yarn | Weft Yarn | Weft Qty (Per Loop) |
|---|---|---|---|---|---|---|---|---|
| 1 | Rigid | Rigid | Rigid | 30 to 100 warps/cm | 10 to 40 wefts/cm | Ne 6 to Ne 60 | Ne 4 to Ne 90 | 2 to 20 wefts |
| 2 | Rigid | Rigid | Rigid | 30 to 100 warps/cm | 10 to 40 wefts/cm | Ne 6 to Ne 60 | Ne 4 to Ne 90 | 2 to 20 wefts |
| 3 | Rigid | Rigid | Elastic | 30 to 100 warps/cm | 10 to 40 wefts/cm | Ne 6 to Ne 60 | Ne 4 to Ne 90 | 2 to 20 wefts |
| 4 | Rigid | Rigid | Elastic | 30 to 100 warps/cm | 10 to 40 wefts/cm | Ne 6 to Ne 60 | Ne 4 to Ne 90 | 2 to 20 wefts |
| 5 | Elastic | Rigid | Rigid | 30 to 100 warps/cm | 10 to 40 wefts/cm | Ne 6 to Ne 60 | Ne 4 to Ne 90 | 2 to 20 wefts |
| 6 | Elastic | Rigid | Rigid | 30 to 100 warps/cm | 10 to 40 wefts/cm | Ne 6 to Ne 60 | Ne 4 to Ne 90 | 2 to 20 wefts |
| 7 | Elastic | Rigid | Elastic | 30 to 100 warps/cm | 10 to 40 wefts/cm | Ne 6 to Ne 60 | Ne 4 to Ne 90 | 2 to 20 wefts |
| 8 | Elastic | Rigid | Elastic | 30 to 100 warps/cm | 10 to 40 wefts/cm | Ne 6 to Ne 60 | Ne 4 to Ne 90 | 2 to 20 wefts |
| 9 | Elastic | Elastic | Rigid | 30 to 100 warps/cm | 10 to 40 wefts/cm | Ne 6 to Ne 60 | Ne 4 to Ne 90 | 2 to 20 wefts |
| 10 | Elastic | Elastic | Rigid | 30 to 100 warps/cm | 10 to 40 wefts/cm | Ne 6 to Ne 60 | Ne 4 to Ne 90 | 2 to 20 wefts |
| 11 | Elastic | Elastic | Elastic | 30 to 100 warps/cm | 10 to 40 wefts/cm | Ne 6 to Ne 60 | Ne 4 to Ne 90 | 2 to 20 wefts |
| 12 | Elastic | Elastic | Elastic | 30 to 100 warps/cm | 10 to 40 wefts/cm | Ne 6 to Ne 60 | Ne 4 to Ne 90 | 2 to 20 wefts |

| | Warp-1 | Frontside Warp Yarn | Warp-2 | Backside Warp Yarn | Weft | Picks | Warp Density (warps/cm) | Weft Density (wefts/cm) | Warp Yarn | Weft Yarn | Weft Qty (Per Loop) |
|---|---|---|---|---|---|---|---|---|---|---|---|
| 13 | Rigid | 16/1 Ring (Rigid) | Rigid | 30/1 Ring (Rigid) | Rigid | 20/1 Ring (Rigid) | 46 | 26 | Ne 6 to Ne 60 | Ne 4 to Ne 90 | Frontside: 4/1 Satin Backside: 1/7 |
| 14 | Rigid | 20/1 Ring (Rigid) | Rigid | 40/1 Ring (Rigid) | Rigid | 24/1 Ring (Rigid) | 53 | 30 | Ne 6 to Ne 60 | Ne 4 to Ne 90 | Frontside: 4/1 Satin Backside: 1/7 |
| 15 | Rigid | 16/1 Ring (Rigid) | Rigid | 24/1 Ring (Rigid) | Elastic | 18/1 Ring + Lycra 78 | 48 | 28 | Ne 6 to Ne 60 | Ne 4 to Ne 90 | Frontside: 3/1 Z Backside: 1/7 |

-continued

| | | | | | | | | | | | |
|---|---|---|---|---|---|---|---|---|---|---|---|
| 16 | Rigid | 20/1 Ring (Rigid) | Rigid | 30/1 Ring (Rigid) | Elastic | 75/2 Denier PES + Lycra 78 dtex (Elastane) | 52 | 30 | Ne 6 to Ne 60 | Ne 4 to Ne 90 | Frontside: 3/1 Broken Twill Backside: 1/8 |
| 17 | Elastic | 16/1 Ring Slub 55 dtex T400 + Lycra 78 (Elastane) | Rigid | 30/1 Ring (Rigid) | Rigid | 20/1 Ring (Rigid) | 62 | 27 | Ne 6 to Ne 60 | Ne 4 to Ne 90 | Frontside: 3/1 Z Backside: 1/11 |
| 18 | Elastic | 24/1 Ring Slub + 55 dtex T400 + Lycra 78 (Elastane) | Rigid | 24/1 Ring (Rigid) | Rigid | 24/1 Ring (Rigid) | 72 | 32 | Ne 6 to Ne 60 | Ne 4 to Ne 90 | Frontside: 1/1 Backside: 1/8 |
| 19 | Elastic | 16/1 Ring Slub 55 dtex T400 + Lycra 78 (Elastane) | Rigid | 30/1 Ring (Rigid) | Elastic | 18/1 Ring 55 dtex T400 + Lycra 78 | 58 | 27 | Ne 6 to Ne 60 | Ne 4 to Ne 90 | Frontside: 2/1 Backside: 1/8 |
| 20 | Elastic | 24/1 Ring Slub + Lycra 78 (Elastane) | Rigid | 24/1 Ring (Rigid) | Elastic | 75/2 Denier PES + Lycra 78 dtex (Elastane) | 70 | 31 | Ne 6 to Ne 60 | Ne 4 to Ne 90 | Frontside: 3/1 Z Backside: 1/11 |
| 21 | Elastic | 16/1 Ring Slub 55 dtex T400 + Lycra 78 (Elastane) | Elastic | 24/1 Ring Slub + Lycra 44 (Elastane) | Rigid | 20/1 Ring (Rigid) | 66 | 28 | Ne 6 to Ne 60 | Ne 4 to Ne 90 | Frontside: 2/1 Backside: 1/11 |
| 22 | Elastic | 20/1 Ring Slub + Lycra 78 (Elastane) | Elastic | 24/1 Ring Slub + Lycra 44 (Elastane) | Rigid | 24/1 Ring (Rigid) | 64 | 30 | Ne 6 to Ne 60 | Ne 4 to Ne 90 | Frontside: 3/1 S Backside: 1/8 |
| 23 | Elastic | 16/1 Ring Slub 55 dtex T400 + Lycra 78 (Elastane) | Elastic | 24/1 Ring Slub + Lycra 44 (Elastane) | Elastic | 18/1 Ring 55 dtex T400 + Lycra 78 | 62 | 27 | Ne 6 to Ne 60 | Ne 4 to Ne 90 | Frontside: 3/1 Z Backside: 1/8 |
| 24 | Elastic | 20/1 Ring Slub + Lycra 78 (Elastane) | Elastic | 24/1 Ring Slub + Lycra 44 (Elastane) | Elastic | 75/1 Denier PES + Lycra 78 dtex (Elastane) | 68 | 32 | Ne 6 to Ne 60 | Ne 4 to Ne 90 | Frontside: 3/1 Broken Twill Backside: 1/8 |

FIGS. 7 through 16 show weave reports referring to different embodiments of a woven fabric according to the disclosure. In the weave reports, the horizontal lines represent consecutive picks and the vertical columns represent individual warp yarns, wherein the "warp yarn 1" designates frontside warp yarns and "warp yarn 2" refers to backside warp yarns. The over portions of the warp yarns are indicated in white and the under portions are indicated as hatched. The individual picks may be formed by one or more weft yarns.

The weave report in FIG. 7 relates to a woven fabric as shown and described above with respect to FIGS. 1 through 3. The weave report of FIG. 8 relates to a weave structure very similar to that shown in FIG. 7, with the difference that the under portion (41) of the frontside warp yarns (4) being arranged such that the diagonal wales extend downwards rather than upwards in comparison to FIG. 7.

FIG. 9 shows a weave report that differs from the ones shown in FIGS. 8 and 9 in that the over portions (43) of the frontside warp yarn (4) are arranged such that two immediately adjacent frontside warp yarns (4) have under portions (41) that are distanced from one another in the warp direction by one pick.

The weave report shown in FIG. 10 has frontside warp yarns (4) that are woven with respect to the picks (6) as shown in FIGS. 7. However, the frontside warp yarns (5) have larger under portions which bypass eleven picks (6) at their back side between two adjacent over portions (53).

FIG. 11 relates to a fabric according to an embodiment of the disclosure having a front that looks very similar to a plain weave. The frontside warp yarns are woven in a 1/1 pattern and the backside warp yarns in a 1/8 pattern to form loose loop portions. In weft direction, the fabric has a repeating pattern consisting of one backside warp yarn and two frontside warp yarns.

The weave report of FIG. 12 relates to a woven fabric in which the frontside warp yarns have over portions spanning over two consecutive picks and under portions bypassing one pick, whereas the backside warp yarns have loop portions bypassing eight consecutive picks at their back side and over portions (connecting points) bypassing one pick.

FIG. 13 shows a weave report in which the backside warp yarns have loop portions bypassing seven picks and over portions (connecting points) bypassing one pick. The weave report shown in FIG. 13 is different from the other weave reports in that the frontside warp yarns comprise two types of frontside warp yarns. The first type of frontside warp yarns (1A) has a 4/1/2/1 weave pattern with a first, large over portion bypassing four picks and a second, small over portion bypassing two picks. The under portions of the first type of picks bypass a single pick. The second type (1B) of frontside warp yarns also has under portions bypassing one pick, but only one type of very large over portions bypassing seven picks.

FIG. 14 shows a weave report of a fabric similar to that of FIG. 12 in which the frontside warp yarns have over portions bypassing two picks and under portions bypassing one pick. The backside warp yarns define loop portions bypassing eleven picks between two over portions that bypass one pick. In the weave report shown in FIG. 14, in warp direction, there are two frontside warp yarns followed by one backside warp yarn.

In FIG. 15, the weave report relates to a fabric that has three consecutive frontside warp yarns in the weft direction between two backside warp yarns. The over portions of the frontside warp yarns bypass three picks. The under portions of the backside warp yarns bypass eleven picks.

In FIG. 16, only one frontside warp yarn arranged immediately adjacent between two adjacent backside warp yarns. Similar to FIG. 15, the backside warp yarns have under portions bypassing eleven picks and the frontside warp yarns having over portions bypassing three picks.

The features disclosed in the above description, the figures and the claims may be significant for the realization of the disclosure in its different embodiments individually as in any combination.

REFERENCE LIST

1, 10, 100 woven fabric
2 front
3 back
4; 4*, 4' frontside warp yarn
5, 5* backside warp yarn
6, 6*, 6''' pick
41, 51 under portion
43, 53 over portion
62 front side
63 back side
71 visible spot
73 hidden spot
A axial frontside warp yarn centerline
B axial backside warp yarn centerline
C central plane
H weft direction
V warp direction
T thickness direction

The invention claimed is:

1. A woven fabric, comprising:
a front and a back;
a plurality of picks extending in weft direction; and
a plurality of warp yarns extending in warp direction and bypassing picks at their frontside to define over portions and bypassing picks at their backside to define under portions, the plurality of warp yarns including frontside warp yarns and backside warp yarns, wherein:
the frontside warp yarns comprise cotton dualcore yarns comprising cotton, elastane and polyester;
the frontside warp yarns and the backside warp yarns are designed and/or woven such that the under portions of the backside warp yarns form loose loops extending looser than the under portions of the frontside warp yarns, the loose loops being at least 25% larger than a distance between which said loose loops extend, wherein at least one of the plurality of backside warp yarns is thinner than at least one of the plurality of frontside warp yarns; and
one of the loose loops is identifiable in the woven fabric in that a length of the backside warp yarn forming the under portion is larger than a distance between over portions between which said loose loop under portion extends.

2. The woven fabric according to claim 1, wherein:
the under portions of the plurality of backside warp yarns bypass more than 2 picks of the plurality of picks or less than 41 picks of the plurality of picks;
the under portions of the backside warp yarns bypass at least one pick of the plurality of picks or at most 40 more picks of the plurality of picks than the under portions of the frontside warp yarns; and/or
a loop ratio of a number of picks of the plurality of picks bypassed by the under portions of one of the plurality of backside warp yarns to a number of picks of the plurality of picks bypassed by the over portions of said backside warp yarns is between 9:1 and 16:1.

3. The woven fabric according to claim 1, wherein:
a sum of the over portions and the under portions of one warp yarn of the plurality of warp yarns in relation to a sum of all picks of the plurality of picks bypassed by said over portions and said under portions defines said yarn's weave tightness, the woven fabric being woven such that the plurality of frontside yarns have a greater weave tightness than the plurality of backside warp yarns; and/or
the plurality of frontside warp yarns have a same shrinkage ratio as, or a greater shrinkage ratio than, the plurality of backside warp yarns.

4. The woven fabric according to claim 1, wherein:
said over portions of the plurality of backside yarns bypass less picks than said under portions of one of the plurality of backside warp yarns;
said over portions of one of the plurality of backside warp yarns bypass no more than one pick of the plurality of picks; and/or
said over portions of the plurality of frontside warp yarns bypass 1 to 5 picks of the plurality of picks.

5. The woven fabric according to claim 1, wherein one of the plurality of backside warp yarns is arranged immediately adjacent to two frontside warp yarns of the plurality of frontside warp yarns, with respect to the weft direction, at least a section of each of said plurality of frontside warp yarns being arranged in front of said adjacent backside warp yarn.

6. The woven fabric according to claim 1, wherein:
said under portions of one of the plurality of frontside warp yarns bypass less picks than said over portions of said frontside warp yarn;
said under portions of one of the plurality of frontside warp yarns bypass no more than one pick; and/or
a ratio of picks bypassed by said under portions of one of the plurality of frontside warp yarns in relation to the picks bypassed by the over portions of said frontside warp yarn defines a visibility ratio which is 1:1 or less.

7. The woven fabric according to claim 1, wherein said frontside warp yarns and said backside warp yarns are designed and/or woven such that the frontside warp yarns form a woven frontside warp yarn arrangement that structurally isolates the backside warp yarns from the front of the woven fabric.

8. The woven fabric according to claim 7, wherein the frontside warp yarns have axial centerlines and define a central warp or weft plane extending through the axial centerlines along the over portions of the frontside warp yarns, the backside warp yarns having axial centerlines, wherein most or all of the axial centerlines of the backside warp yarns extend along their entire extension in the warp direction on the backside of the central warp or weft plane.

9. A method for producing a woven fabric, comprising:
providing one or more weft yarns for weaving picks and a plurality of warp yarns; and
weaving the fabric so that the plurality of warp yarns form over portions bypassing the picks at their frontside and under portions bypassing picks at their backside to realize a plurality of frontside warp yarns and a plurality of backside warp yarns in that the plurality of frontside warp yarns are selected and/or woven such that the under portions of the plurality of frontside warp yarns are loose loops extending at the back of the fabric that are looser than the under portions of the plurality of backside warp yarns, the loose loops being at least 25% larger than a distance between which said loose loops extend, wherein:
at least one of the plurality of backside warp yarns is thinner than at least one of the plurality of frontside warp yarns, the plurality of frontside warp yarns comprise cotton dualcore yarns comprising cotton, elastane and polyester, and one of the loose loops is identifiable in the woven fabric in that a length of the backside warp yarn forming the under portion is larger than a distance between over portions between which said loose loop under portion extends.

10. The method for producing a woven fabric according to claim 9, further comprising:

shrinking the woven fabric, the under portions of the backside warp yarns forming loops on the back on the fabric, wherein the fabric is woven such that, after the woven fabric is removed from the loom, and before the woven fabric is washed and/or finished, the woven fabric has a weft density between 2 weft yarns/cm and 60 weft yarns/cm.

11. The method for producing a woven fabric according to claim 9, wherein providing the plurality of warp yarns comprises:

selecting different materials for the plurality of frontside warp yarns then for the plurality of backside warp yarns such that the plurality of frontside warp yarns have a greater shrinkage ratio than the plurality of backside warp yarns.

12. The method for producing a woven fabric according to claim 9, wherein the fabric is woven such that at least a section of each of the plurality of frontside warp yarns are arranged in front of the plurality of backside warp yarns during weaving and/or during shrinking.

13. The method for producing a woven fabric according to claim 9, wherein the warp yarns are selected and/or woven such that the frontside warp yarns are laterally in contact with each other and form a woven frontside warp yarn arrangement that structurally isolates the backside warp yarns from the front of the fabric.

14. A woven fabric, comprising:

a front and a back;

a plurality of picks extending in weft direction; and a plurality of warp yarns extending in warp direction and bypassing picks at their frontside to define over portions and bypassing picks at their backside to define under portions, the plurality of warp yarns including frontside warp yarns and backside warp yarns, wherein:

the frontside warp yarns comprise cotton dualcore yarns comprising cotton, elastane and polyester;

the frontside warp yarns and the backside warp yarns are designed and/or woven such that the under portions of the backside warp yarns form loose loops extending looser than the under portions of the frontside warp yarns, the loose loops being at least 25% larger than a distance between which said loose loops extend, wherein the frontside warp yarns are indigo dyed warp yarns and the backside warp yarns are not indigo dyed warp yarns; and one of the loose loops is identifiable in the woven fabric in that a length of the backside warp yarn forming the under portion is larger than a distance between over portions between which said loose loop under portion extends.

15. A method for producing a woven fabric, comprising:

providing one or more weft yarns for weaving picks and a plurality of warp yarns; and weaving the fabric so that the plurality of warp yarns form over portions bypassing the picks at their frontside and under portions bypassing picks at their backside to realize a plurality of frontside warp yarns and a plurality of backside warp yarns in that the plurality of frontside warp yarns are selected and/or woven such that the under portions of the plurality of frontside warp yarns are loose loops extending at the back of the fabric that are looser than the under portions of the plurality of backside warp yarns, the loose loops being at least 25% larger than a distance between which said loose loops extend, wherein:

the plurality of frontside warp yarns are indigo dyed and the plurality of backside warp yarns are not indigo dyed, the plurality of frontside warp yarns comprise cotton dualcore yarns comprising cotton, elastane and polyester, and one of the loose loops is identifiable in the woven fabric in that a length of the backside warp yarn forming the under portion is larger than a distance between over portions between which said loose loop under portion extends.

16. The woven fabric according to claim 1, wherein the frontside warp yarns are elastic yarns.

17. The method according to claim 15, wherein the woven fabric is a denim fabric.

18. The woven fabric according to claim 1, wherein the woven fabric comprises at least as many frontside warp yarns as backside warp yarns.

19. The woven fabric according to claim 1, wherein the woven fabric is a denim fabric.

20. The woven fabric according to claim 1, wherein the frontside warp yarns are dualcore yarns.

* * * * *